US006807282B2

(12) United States Patent
Kaneda et al.

(10) Patent No.: US 6,807,282 B2
(45) Date of Patent: Oct. 19, 2004

(54) ELECTROMAGNETIC INDUCTION TYPE ACTUATOR DEVICE AND MOUNTING STRUCTURE THEREFOR AND PDA (PERSONAL DIGITAL ASSISTANT)

(75) Inventors: Shoichi Kaneda, Adachi-ku (JP); Tsuneo Kyono, Adachi-ku (JP); Minoru Ueda, Adachi-ku (JP); Fumio Fujimori, Adachi-ku (JP)

(73) Assignee: Namiki Seimitsu Houseki Kabushiki Kaisha, Tokyo (JP)

( * ) Notice: Subject to any disclaimer, the term of this patent is extended or adjusted under 35 U.S.C. 154(b) by 28 days.

(21) Appl. No.: 10/089,934

(22) PCT Filed: Aug. 3, 2001

(86) PCT No.: PCT/JP01/06710

§ 371 (c)(1),
(2), (4) Date: Apr. 5, 2002

(87) PCT Pub. No.: WO02/11904

PCT Pub. Date: Feb. 14, 2002

(65) Prior Publication Data

US 2002/0153983 A1 Oct. 24, 2002

(30) Foreign Application Priority Data

Aug. 8, 2000 (JP) ..... 2000-239926
Mar. 7, 2001 (JP) ..... 2001-63137

(51) Int. Cl.[7] ..... H04R 25/00
(52) U.S. Cl. ..... 381/396; 381/412
(58) Field of Search ..... 335/252, 220–229; 381/396, 409–413, 344–345, 401–402

(56) References Cited

U.S. PATENT DOCUMENTS 6,038,327 A * 3/2000 Bleim et al. ..... 381/344
6,590,991 B1 * 7/2003 Maeda ..... 381/409

FOREIGN PATENT DOCUMENTS

| | | |
|---|---|---|
| EP | 1 044 730 | 10/2000 |
| EP | 1 045 613 | 10/2000 |
| JP | 10-117460 | 5/1998 |
| JP | 2001-025204 | 1/2001 |
| JP | 2001-225010 | 8/2001 |
| JP | 2001-259525 | 9/2001 |

* cited by examiner

*Primary Examiner*—Lincoln Donovan
(74) *Attorney, Agent, or Firm*—Nixon Peabody LLP; Donald R. Studebaker

(57) ABSTRACT

There is a terminal block with leaf spring metal terminals that extend downward from a housing on the side opposite the open end of the housing in which a diaphragm is fitted and fixed, and an elastic material functions as a pad that is sandwiched between the surface of a circuit board and the open side of the housing on the side from which the metal terminals project, with the metal terminals pressed against the conduction pattern of the circuit board to make an electrical connection. Alternatively, the contact point that is connected electrically to the conductive pattern of the circuit board is on the side on which the diaphragm is mounted and the metal terminals have flat plates for electrical connection of voice coil lead wires on the side opposite that where the diaphragm is mounted, so that the voice coil lead wires extend outside the housing and are connected electrically to the flat plates of the metal terminals on the side opposite the side where the diaphragm is mounted, and the side where the diaphragm is mounted faces the surface of the circuit board and away from the inside of the outer casing of the equipment.

8 Claims, 18 Drawing Sheets

ELECTROMAGNETIC INDUCTION TYPE ACTUATOR DEVICE AND MOUNTING STRUCTURE THEREFOR AND PDA (PERSONAL DIGITAL ASSISTANT)

FIELD OF INDUSTRIAL USE

This invention is primarily a vibration generator; it concerns improvement of electromagnetic induction actuators with the function of generator a ring or buzz; a structure for mounting an electromagnetic induction actuator that is improved by means of a more secure electrical connection between the electromagnetic induction actuator and the conduction pattern of the circuit board; and portable information equipment, including portable telephones, that is fitted with electromagnetic induction actuators.

PRIOR ART

Generally speaking, electromagnetic induction actuators have, as shown in FIG. 36, a cylindrical housing 10 that encloses a magnetic circuit that consists of a pole piece 13, a magnet 11 connected to the pole piece 13, and a yoke 12 that holds the magnet 11 to the pole piece 13 separated by an electromagnetic gap G; the magnetic circuit is suspended within the housing 10 by spring suspension 14*a*, 14*b*; there is a diaphragm 15 with a voice coil 16 mounted inward from the diaphragm 15, of which the voice coil 16 is inserted into the electromagnetic gap G between the pole piece 13 and the yoke 12 and the diaphragm 15 is suspended at the framework 10*a* of the housing 10; metal terminals 58*a*, 58*b* are attached to the terminal block 10*d* that projects from the end of the housing 10, and the voice coil 16 is electrically connected to the metal terminals 58*a*, 58*b*.

This electromagnetic induction actuator is constituted such that the magnetic action of the magnet 11 and the current applied on the voice coil 16 cause vibration of the springs 14*a*, 14*b* that support the magnetic circuit when a low frequency signal is applied, and a ring or buzz from the diaphragm 15 when a high frequency signal is applied.

To electrically connect between the conduction pattern on the circuit board inside the portable telephone or other portable information equipment to the voice coil in order to vibrate during operation, the conventional electromagnetic induction actuator described above uses a flexible cord that extends from a metal terminal that is electrically connected to the voice coil. This flexible cord itself can withstand vibration, but there is a problem in that contact is easily broken because of the load placed on the contact with the metal terminal or the contact with the conductive pattern on the circuit board.

Therefore, in order to resolve such problems, proposals have been made for the electrical connection between the vibration mechanism and the conduction pattern on the circuit board, including a method of extending a leaf spring at a slant from the case of an eccentric weight vibration mechanism have an eccentric weight and pressing it against the power feed land to make an electrical connection between the vibration mechanism and the conduction pattern of the circuit board, (JPO Kokai Patent Report H11-136901 of 1999), and a method of pressing the leaf spring against the power feed land by using an elastic pressure body attached to the outside of the vibration mechanism case to make an electrical connection between the vibration mechanism and the conductive pattern of the circuit board (JPO Kokai Patent Report 2000-78790).

In the case of these leaf spring electrical contacts, however, it is necessary to mount the vibration mechanism with accurate positioning that maintains a steady gap between the vibration mechanism and the surface of the printed circuit board. When the leaf spring is pressed by an elastic pressure body attached to the outside of the vibration mechanism case, especially, excessive pressure on the leaf spring is liable to cause it to eat into the elastic pressure body, causing poor contact.

Moreover, the conventional electromagnetic induction actuator shown in FIG. 36 is mounted in the case of the portable telephone or other equipment by placing the side where the diaphragm 15 attaches toward the outer casing of the portable information equipment and the side where the cover 18 attaches toward the surface of the circuit board, and electrically connecting the metal terminals 58*a*, 58*b* to the conduction pattern of the circuit board.

With the electromagnetic induction actuator described above, in order to increase the speed of the physically heavy magnetic circuit as it vibrates, flux leakage from the magnetic circuit modulates the vibration frequency and creates an alternating magnetic field; this creates an alternating magnetic field leak outside the portable electronic equipment from the side where the diaphragm 15 attaches, and so there is concern about the effect on magnetic memory cards outside the equipment.

One conceivable way to prevent the effects of this alternating magnetic field is to turn the side where the cover 18 is mounted, where there is little flux leakage, toward the outer casing of the equipment instead of the side where the diaphragm 15 is mounted, and placing it inside the telephone or other equipment with the diaphragm 15 side toward the surface of the circuit board.

However, if the electromagnetic induction actuator described above is simply reversed, the side where the leads 8*a*, 8*b* of the voice coil 16 are soldered to the metal terminals 58*a*, 58*b* will be positioned opposite the conduction pattern of the circuit board, and so there is a danger that the solder mound will interfere with the electrical contact between the metal terminals 58*a*, 58*b* and the conduction pattern of the circuit board.

In view of the problems described above, first of all, a sure means of conduction between the voice coil and the conduction pattern of the circuit board without using a flexible cord is desired.

Second, and even better, a means of resolving the problem of flux leakage in addition to the sure means of conduction is desired.

Accordingly, the purpose of this invention is to enable a sure electrical connection by pressing the metal terminals of the vibration mechanism against the conduction pattern of the circuit board while maintaining the relative gap between the vibration mechanism and the circuit board, and also to provide a structure for mounting the electromagnetic induction actuator that is improved so as to prevent damage to the internal mechanism due to impact, and to prevent resonance that would result from excessive vibration of the ringing mechanism being transferred to the circuit board or the outer casing.

A further purpose is to provide a structure for mounting the electromagnetic induction actuator that is improved so as to prevent acoustical leakage within the outer casing and thus improve the acoustic characteristics.

In addition, it has the purpose of providing a structure for mounting the electromagnetic induction actuator that is improved so as to enable simple mounting of the electromagnetic induction actuator while accurately maintaining the relative gap between it and the circuit board.

Moreover, this invention has the primary objective of suppressing the effects of the alternating magnetic field by mounting the electromagnetic induction actuator in the equipment with the side where the diaphragm is mounted turned toward the surface of the circuit board and the opposite side turned toward the cover panel of the equipment, and has the purpose of providing an electromagnetic induction actuator that can be mounted easily within equipment with an electrical circuit connection between the metal terminal and the power feed land of the circuit board.

This invention also has the purpose of providing an electromagnetic induction actuator that firmly attaches the metal terminals to the terminal block of the housing and makes a sure electrical contact with the conduction pattern of the circuit board, and one which is a compact unit overall, as well as the purpose of providing portable telephones and other portable information equipment that suppresses the alternating magnetic field while incorporating an electromagnetic induction actuator as a mechanism for generating vibrations, ringing or buzzing.

DESCRIPTION OF INVENTION

This electromagnetic induction actuator has, within a cylindrical housing, a magnetic circuit that comprises a pole piece and a magnet connected as one piece, and a yoke that holds the pole piece together with the magnet, and a magnetic gap formed between the yoke and the pole piece, the magnetic circuit being suspended within the housing by spring suspension; a diaphragm, which attaches a voice coil on inward surface side, the voice coil projecting into the magnetic gap and the diaphragm extending inside the housing at an open side; metal terminals that are attached to a terminal block that projects outward from the side wall of the housing; and lead wires that electrically connect the voice coil and the metal terminals; in which the metal terminal attached to the terminal block is formed of a leaf spring, so that pressing the terminal fitting against the conduction pattern of a circuit board forms a sure electrical connection to the circuit board.

With this invention, it is possible to assure connectivity between the voice coil and the conduction pattern of the circuit board without using a flexible cord.

Further, the structure for mounting the electromagnetic induction actuator of this invention is one that has within a cylindrical housing, a magnetic circuit that comprises a pole piece and a magnet connected as one piece, and a yoke that holds the pole piece together with the magnet, and a magnetic gap formed between the yoke and the pole piece, the magnetic circuit being suspended within the housing by spring suspensions; a diaphragm, which attaches a voice coil on inward surface side, the voice coil projecting into the magnetic gap and the diaphragm extending inside the housing at an open side; metal terminals that are attached to a terminal block that projects outward from the side wall of the housing; and lead wires that electrically connect the voice coil and the metal terminals, and the structure is formed that connecting the metal terminals against the conduction pattern of a circuit board and providing in outer casing; in which there is the metal terminals attached to the terminal block is formed of leaf springs, and the metal terminals extend to the outward side of the housing that the side is opposite side of the open side of the housing in which the diaphragm is fitted and fixed, and there a pad of elastic material is sandwiched between the open side of the housing and the surface of the circuit board on the side where the metal terminals project, so that pressing the metal terminal against the conduction pattern of the circuit board forms a sure electrical connection to the circuit board.

With this invention, the elastic material is compressed and maintains a certain thickness, and can be placed to maintain the gap between the electromagnetic induction actuator and the surface of the circuit board, so that pressing the metal terminal is deformed by compression and is in very close contact with the conduction pattern of the circuit board and forms a sure electrical connection to the circuit board.

Further, the structure for mounting the electromagnetic induction actuator of this invention has a terminal block with a terminal fitting that is a leaf spring of which the tip is bent in a V shape, with the knuckle slanting outward from the housing, and this leaf spring is pressed flexibly against the conductive pattern of the circuit board to make the electrical connection between the metal terminal and the conduction pattern of the circuit board.

With this invention, the electromagnetic induction actuator is held firmly in place, and at the same time the contact point of the leaf spring that is deformed into a rounded claw shape electrically connects the metal terminal to the conduction pattern of the circuit board.

Also, in the structure for mounting an electromagnetic induction actuator of this invention, there is a bushing of elastic material with circular extension flanges that covers from the outside the side wall of the housing, except for the terminal block for the metal terminals, and that covers the open sides of the housing, such that the extension flange that covers one open side of the housing becomes a pad that is sandwiched between the housing and the surface of the circuit board, and the extension flange that covers the other open side of the housing is positioned inside the outer casing as a seal that surrounds the sound holes.

With this invention, the elastic material can be applied easily, the leaf spring of the metal terminal provides a sure electrical connection, and the extension flanges prevent the resonance and acoustical leakage that would be transferred from the electromagnetic induction actuator to the circuit board or outer casing. The bushing provides good acoustical characteristics and prevents damage to the internal structure due to impact.

In this invention's structure for mounting an electromagnetic induction actuator, there is a projection around the outer periphery of the side wall of the bushing, and an outer casing or circuit board with a stop rim that has a concavity that fits the projection of the bushing, such that fitting the projection of the bushing into the concavity attaches the electromagnetic induction actuator that includes a bushing to the stop rim of the outer casing or circuit board.

With this invention, the electromagnetic induction actuator can be simply fixed within the outer casing while maintaining a fixed gap between the electromagnetic induction actuator and the surface of the circuit board.

In this invention's structure for mounting an electromagnetic induction actuator, there is a housing with plural projections of elastic material at intervals along the outer periphery of the side wall and there is an outer casing or circuit board with a stop rim having concavities into which the projections of the housing fit, such that fitting the projections of the housing into the concavities attaches the electromagnetic induction actuator to the stop rim of the outer casing or circuit board.

With this invention, the projections on the side wall of the housing allow the electromagnetic induction actuator to be simply fixed within the outer casing while maintaining a fixed gap between the electromagnetic induction actuator and the surface of the circuit board.

In this invention's structure for mounting an electromagnetic induction actuator, the elastic material that covers an open side of the housing acts as a pad sandwiched between that open side of the housing and the surface of the circuit board, and the seal material that covers the other open side encloses the sound holes and fits into the inner surface of the outer casing.

With this invention, the pad material and seal material, together with the projections on the side wall of the housing, prevent acoustical leakage and the resonance from vibration produced by the electromagnetic induction actuator that otherwise would be transferred to the circuit board and outer casing.

In this invention's structure for mounting an electromagnetic induction actuator, there is a circular projecting band of elastic material that faces the surface of the circuit board, the circular band being sandwiched between one open side of the housing and the surface of the circuit board as a pad that is deformed by compression.

With this invention, resonance is prevented more surely because the projecting band has a small area of contact with the surface of the circuit board, and the contact is very close.

In this invention's structure for mounting an electromagnetic induction actuator, the electromagnetic induction actuator is suited to mounting within a portable telephone.

With this invention, it is possible to constitute a portable telephone with superior electrical makeup, good acoustical qualities and excellent shock resistance.

This invention's electromagnetic induction actuator has, within a cylindrical housing, a magnetic circuit that comprises a pole piece and a magnet connected as one piece, and a yoke that holds the pole piece together with the magnet, and the magnetic gap formed between the yoke and the pole piece, the magnetic circuit being suspended within the housing by spring suspensions; a diaphragm, which attaches a voice coil on inward surface side, the voice coil projecting into the magnetic gap and the diaphragm extending inside the housing at an open side; metal terminals that are attached to a terminal block that projects outward from the side wall of the housing; and lead wires that electrically connect the voice coil and the metal terminals; in which the metal terminals are made of leaf springs, and the metal terminals comprise contact points that connect electrically to the conduction pattern of the circuit board are on the side where the diaphragm is mounted, and flat plates that are electrically connected to the voice coil lead wires being taken out to the outward side of the housing, additionally these wires are taken out to the side opposite the side where the diaphragm is mounted, and these wires are attached to leaf spring terminal fittings on the side opposite, the voice coil lead wires being divided by positive and negative polarity and electrically connecting the side where the diaphragm is mounted to the flat plates of the metal terminals, with the side where the diaphragm is mounted facing surface of the circuit board, and mounted upside-down in the equipment case.

With this invention, the side where the diaphragm is mounted, where there is much flux leakage, can be placed within the equipment facing the surface of the circuit board, and so the adverse effects of the alternating magnetic field on magnetic storage cards can be suppressed. Moreover, because the voice coil lead wires are soldered on the side of the housing opposite that where the diaphragm is mounted, there is no interference with the electrical circuit contact between the metal terminals and the power feed lands of the circuit board, and so mounting within the equipment can be done easily.

In this invention's electromagnetic induction actuator, the terminal block has in its center a slit that divides it for positive and negative polarities, the voice coil lead wires being taken out to the outward side of the housing go through the slit of the terminal block, and are taken out from the side where the diaphragm is mounted to the opposite side of the side where the diaphragm is mounted, and the lead wires are divided by positive and negative polarity and are connected electrically to the flat plates of the metal terminals.

With this invention, the voice coil lead wires are laid out over a short distance with good stability, and a sure electrical connection with the flat plates of the metal terminals is possible.

In this invention's electromagnetic induction actuator, there is terminal blocks for positive and negative polarity comprise sink in the center of the terminal block, top plates and bottom plates of the sink, and side plates of the sink projecting further than the top plates and the bottom plates, and in which the metal terminals, each having a fitted bend in the center with a left-opening box-shaped, upward from the top of the fitted bend by a given interval is the parallel flat plate to which the lead wire, and downward from the fitted bend the leaf spring extends at a slant and is then rounded upward with a contact point that contact the conduction pattern, such that when the fitted bend is inserted into the sink, and the top plate of the terminal block is clamped between the top of the fitted bend and the flat plate for attachment of a lead wire, the contact point for connection to the conduction pattern of the circuit board projects from the bottom plate, and the terminal fittings is supported by the two side plates, the terminal fittings firmly attached to the terminal block.

With this invention, just pressing the fitted bend into the sink will fix the metal terminal firmly in the terminal block.

In this invention's electromagnetic induction actuator, the metal terminals have a number of teeth projecting outward from both sides of top of the fitting bend and spring arms that extend from the top of the fitting bend, and the terminal blocks has spaces that correspond to thickness of the spring arms and receiving plates that face the top plates on the inner face of side plates, and the spring arms fit between the top plate of the terminal block and the receiving plate of the side plates, and the teeth are compressed by the inner face of side plates, thus, the terminal fittings firmly attached to the terminal block.

With this invention, the metal terminal can be fixed even more firmly in the terminal block.

In this invention's electromagnetic induction actuator, the metal terminals have wing-shaped leaf springs that curves outward at the top of the leaf springs where wing-shaped leaf springs are bent back from the contact points and that extend toward the sides of the terminal block, and the terminal block has receiving plates on the inner wall of its side plates that stop and support the wing-shaped leaf springs when the leaf spring is compressed, such that the metal terminals are mounted in the terminal block by a fitted structure that allows spring movement of the contact points.

With this invention, the metal terminal can move resiliently as the contact point is pressed against the conduction pattern of the circuit board. Because receiving piers press on the side leaf springs and maintain a strong pressure against the conduction pattern, the metal terminals have a sure electrical contact with the conductive pattern of the circuit board.

In this invention's electromagnetic induction actuator, there is a metal terminal which has, running along the center of the curve of the contact point, a projecting band that contacts the power feed land of the circuit board.

With this invention, an even surer electrical contact between the metal terminal and the conductive pattern is possible because there is no distortion of the contact point when pressed firmly against the conduction pattern of the circuit board.

This invention's portable information equipment, such as a portable telephone, produces vibration, an audible ring or buzz by means of an electromagnetic induction actuator.

With this invention, the side of the housing where the diaphragm is mounted, where there is much flux leakage, is mounted within the equipment facing the surface of the circuit board, and so it is possible to have portable information equipment in which the effects of the alternating magnetic field are suppressed.

OPTIMUM MODE OF IMPLEMENTATION

Implementation Mode 1

Figure 1:
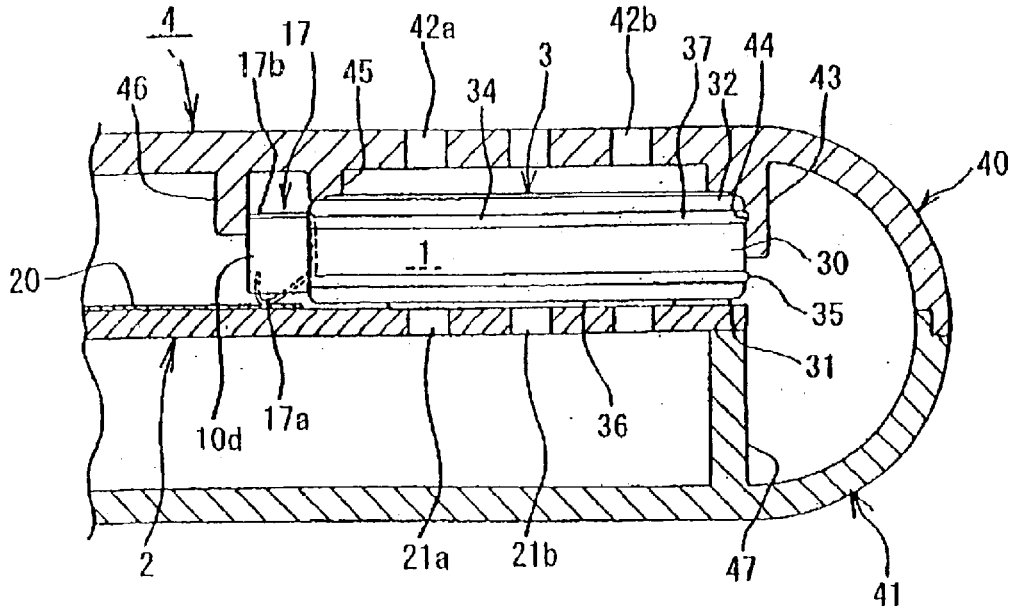
FIG. 1 is an explanatory drawing of the internal structure of a portable telephone that applies the structure for mounting the electromagnetic induction actuator of implementation mode 1 of this invention.

Implementation mode 1 is explained below with reference to the drawings. FIG. 1 shows an electromagnetic induction actuator of the optimum mode assembled inside a portable telephone. This electromagnetic induction actuator 1 is electrically connected to the conduction pattern 20 of the circuit board 2 (the direct connection is to a conduction land) by the leaf spring 17*a* of a metal terminal 17 to be described hereafter, and it covered on the outside by a bushing 3 of elastic material to be described and set in an external housing 4. Now, the electromagnetic induction actuator 1 in the drawing is located inside the bushing 3.

Figure 2:
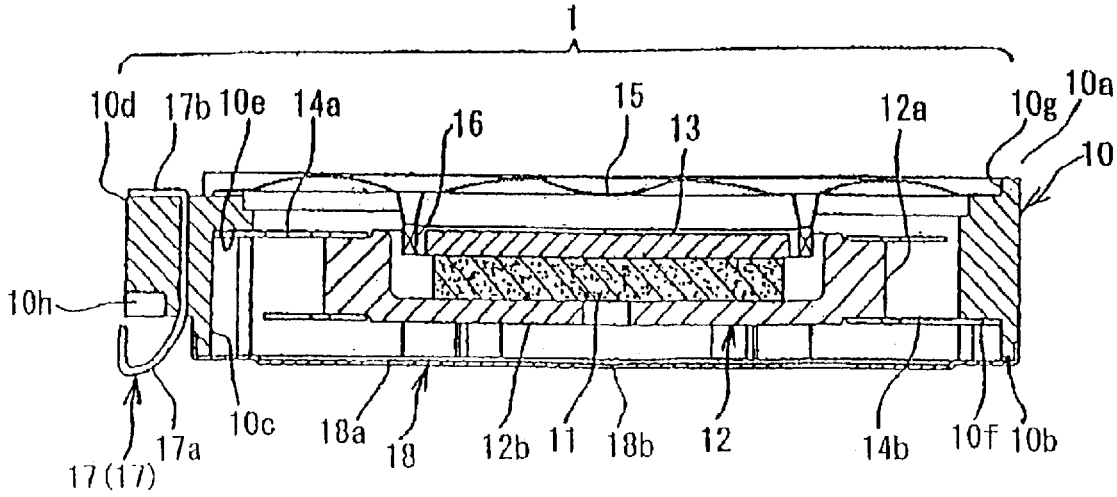
FIG. 2 is a cross section showing the structure of the electromagnetic induction actuator used in implementation mode 1 of this invention.
Figure 3:
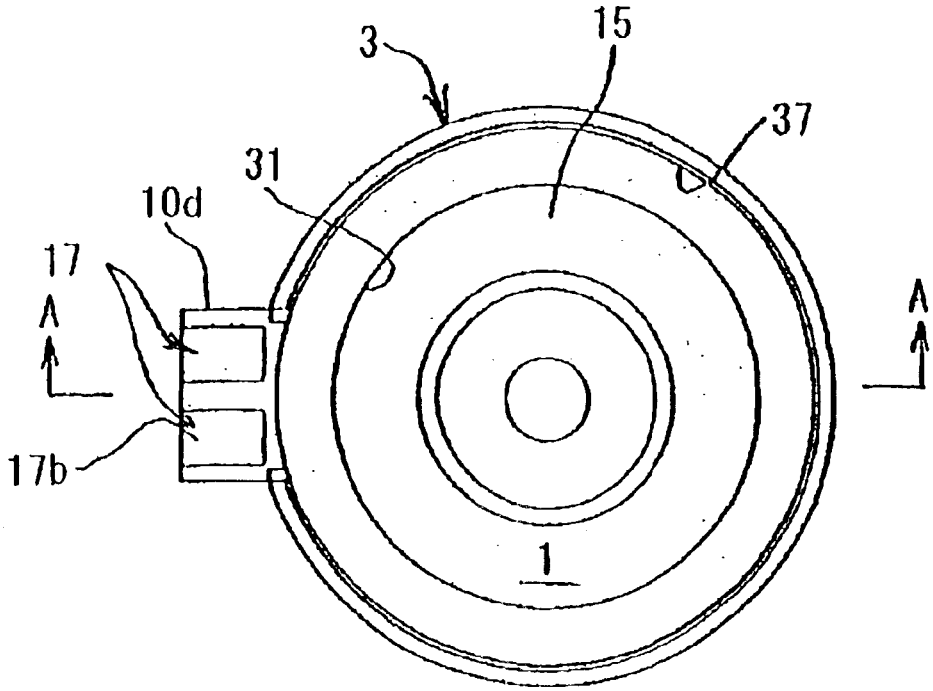
FIG. 3 is a plane view from the diaphragm side of the electromagnetic induction actuator, covered by a bushing, used in the structure for mounting of implementation mode 1 of this invention.
Figure 4:
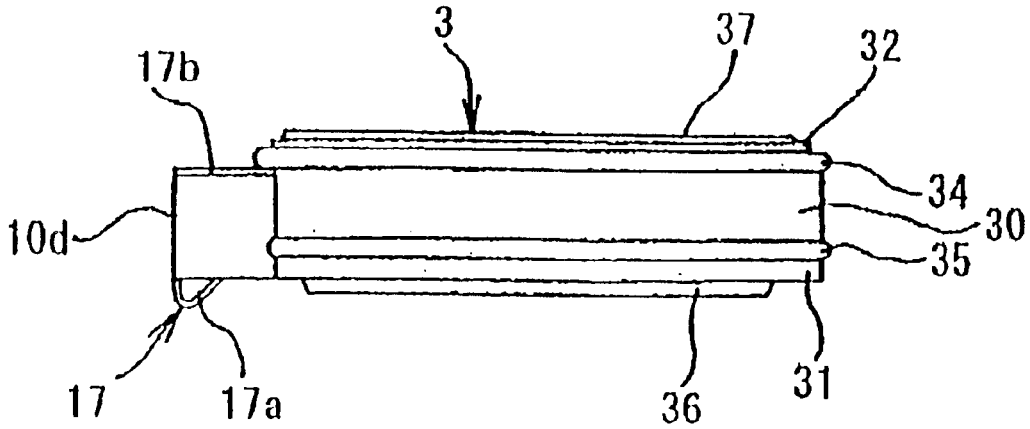
FIG. 4 is a side view of the electromagnetic induction actuator of FIG. 3.
Figure 5:
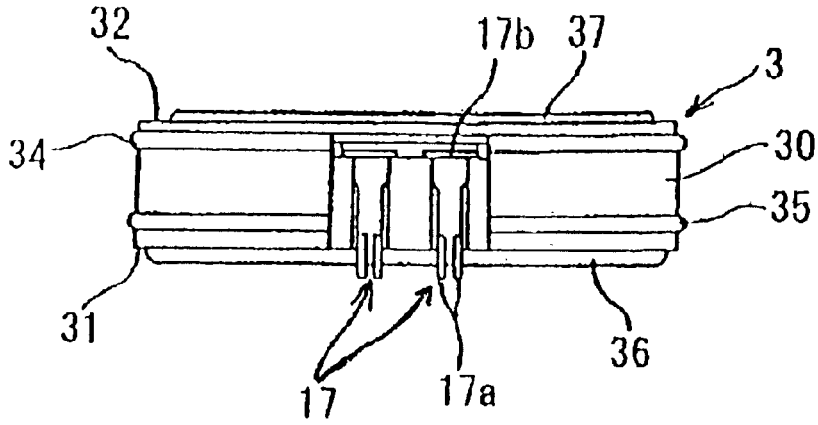
FIG. 5 is a front view of the electromagnetic induction actuator of FIG. 3.
Figure 6:
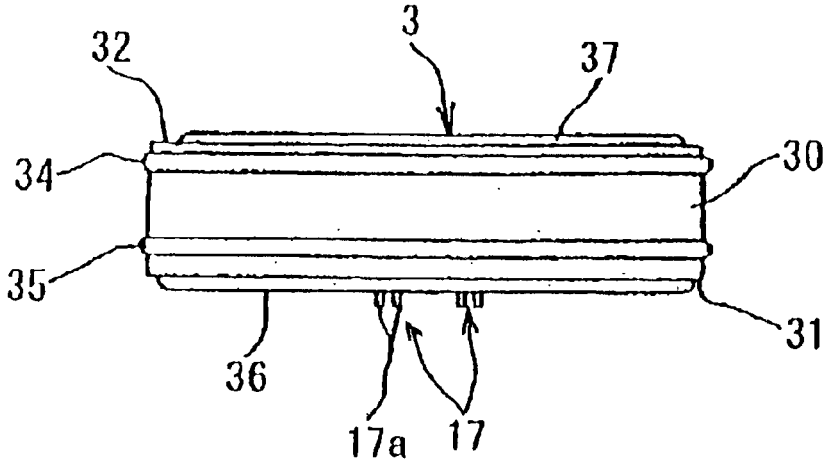
FIG. 6 is a back view of the electromagnetic induction actuator of FIG. 3.
Figure 7:
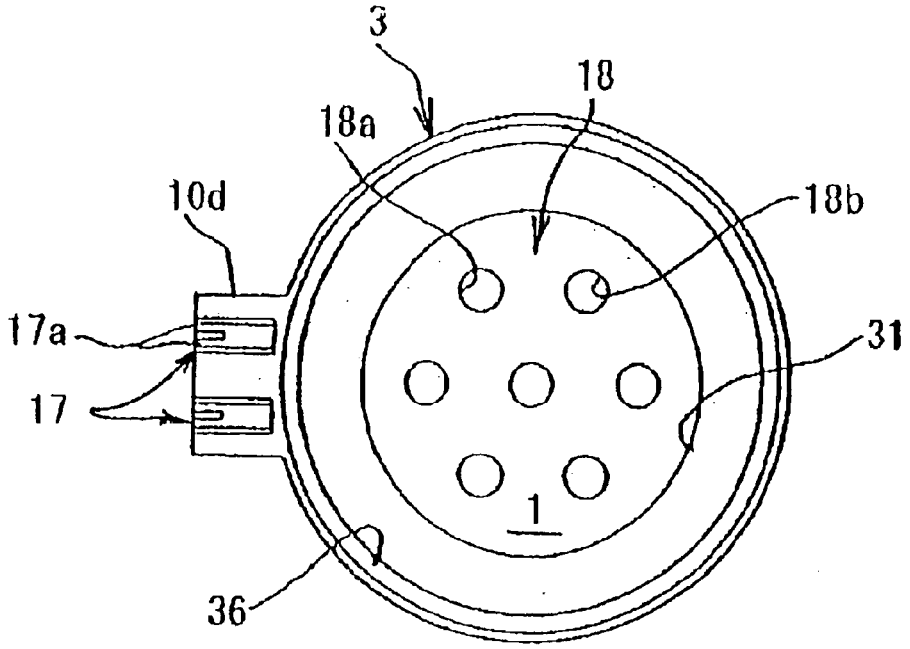
FIG. 7 is a bottom view of the electromagnetic induction actuator of FIG. 3.
Figure 8:
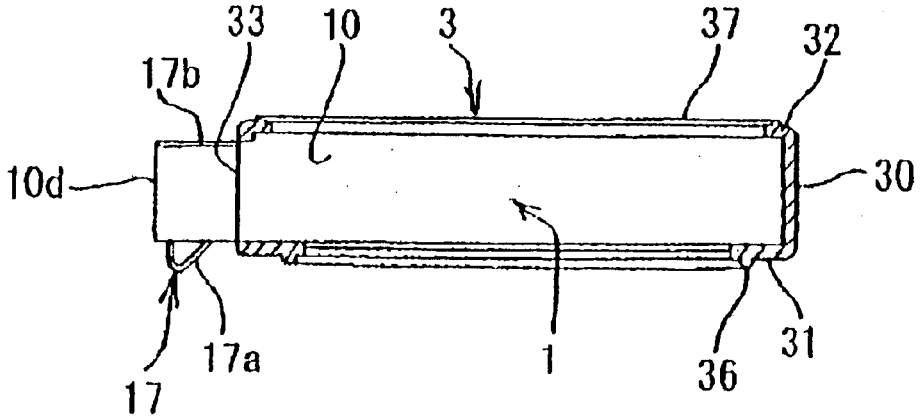
FIG. 8 is a cross section taken at line A—A in FIG. 3 of the electromagnetic induction actuator of FIG. 3.
Figure 9:
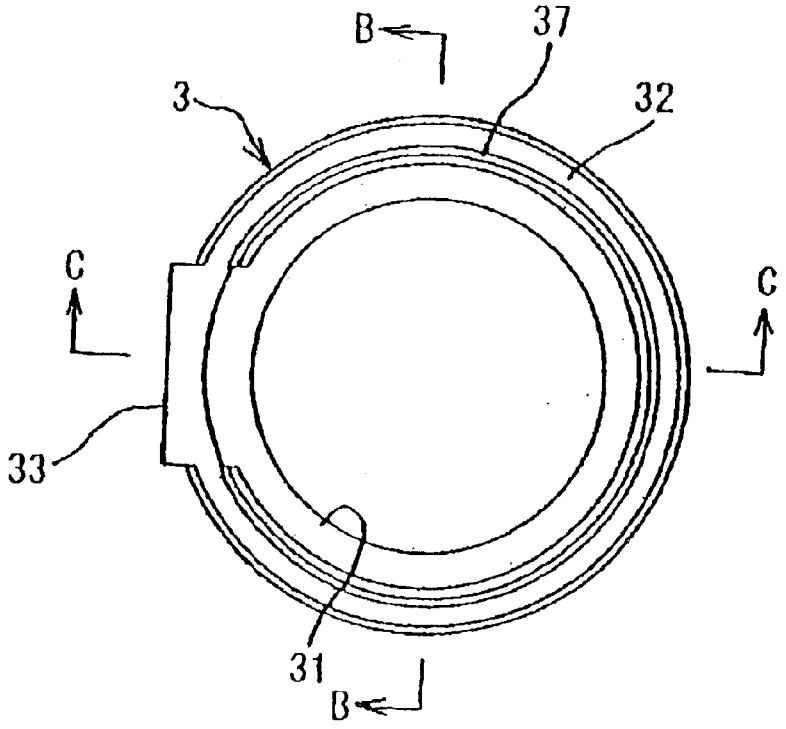
FIG. 9 is a plane view of the bushing in FIG. 3.
Figure 10:
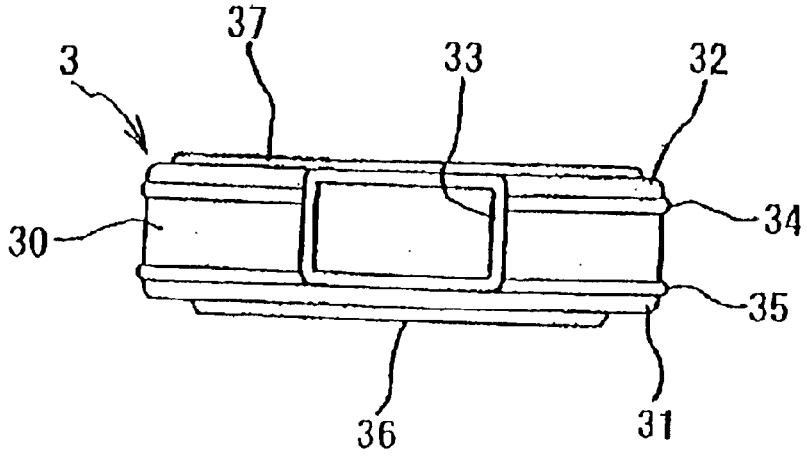
FIG. 10 is a front view of the bushing in FIG. 3.
Figure 11:
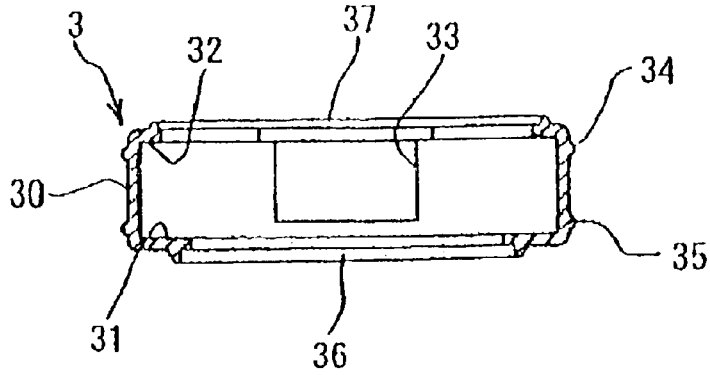
FIG. 11 is a cross section taken at line B—B in FIG. 9 of the bushing in FIG. 3.
Figure 12:
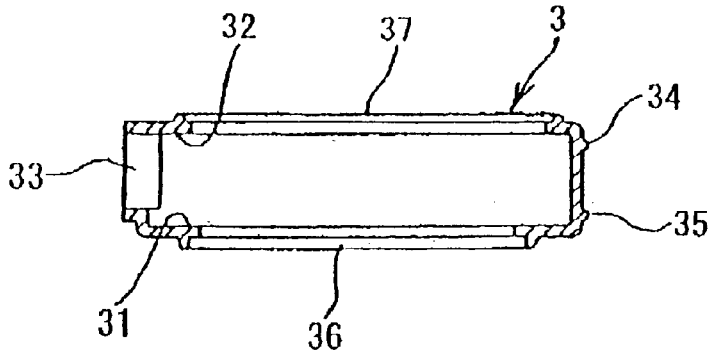
FIG. 12 is a cross section taken at line C—C in FIG. 9 of the bushing in FIG. 3.

The electromagnetic induction actuator 1 is framed in a cylindrical housing 10 with open sides 10*a*, 10*b* as shown in FIG. 2. A magnet 11 for generating magnetism, a magnet yoke 12 and a pole piece 13 that sandwiches the magnet 11, and make up the magnetic circuit, and the outer periphery 12*a* of the yoke 12 is suspended within the housing 10 by leaf springs 14*a*, 14*b*.

Moreover, there are a diaphragm 15 that is fitted and fixed in the open side 10*a* of the housing 10, a voice coil 16 that is mounted to the inside of the diaphragm 15, and metal terminals 17 used for positive and negative polarity mounted on terminal block 10*d* which projects outward from the side wall 10*c* of the housing 10. Lead wires (not illustrated) electrically connect the voice coil 16 to the terminal fittings 17, and a cover 18 with plural sound holes 18*a*, 18*b* . . . is fitted and fixed to the open side 10*b* of the housing 18.

Within this constitution, the magnet 11 and the pole piece 13 are mounted one over the other within the concavity 12*b* of the yoke 12, and are thus assembled as something of the internal magnet type. The outer ends of the springs 14*a*, 14*b* are fitted and fixed inside internal steps 10*e*, 10*f* in the side wall 10*c* of the housing 10. The outer edge of the diaphragm 15 is fitted and fixed in the internal step 10*g* of the open side 10*a* of the housing 10.

The positive and negative metal terminals 17 are formed by bending a thin metal sheet of good electrical conductivity, such as phosphor bronze or titanium bronze; the knuckle projects down and outward from the housing 10 and the leaf spring 17*a* has a forked tip bent in a V shape. These metal terminals 17 are inserted into the terminal block 10*d* that is formed when the housing 10 is molded of resin, and continue back to contact sheets 17*b* to which the lead wires of the voice coil 16 are connected.

The bushing 3 is molded of an elastic material such as rubber or silicone. This bushing 3 is made up of a side wall 30 that covers the outside of the side wall 10*c* of the casing 10 with the exception of the terminal block 10 and its metal terminals 17, and ring-shaped extension flanges 31, 32 that cover the open edges 10*a*, 10*b* of the housing 10, as shown in FIGS. 3 through 8. Because, the extension flanges 31, 32 are ring-shaped in form, they do not cover the central surface of the cover 18 in which there are sound holes 18*a*, 18*b* . . . or the cental portion of the diaphragm 15.

As shown in FIGS. 9 through 12, the bushing 3 has an opening 33 through which the terminal block 10*d* projects. Moreover, there are circular projections 34, 35, which are semicircular in profile, around the outer circumference of the side wall 30. There is also a circular band 36 on the surface of the extension flange 31 that faces the surface of the circuit board. As will be described hereafter, the extension flange 32 receives pressure from a push rim on the inner side of the outer casing, and so it is possible to have a band 37, similar to the circular band 36, on the surface of the extension flange 32.

As shown in FIG. 1, the circuit board 2 so that the electromagnetic induction actuator 1 faces the conduction pattern 20 that is electrically connected to the various necessary circuits. This circuit board 2 also has a number of through holes 21*a*, 21*b* . . . that line up with the sound holes 18*a*, 18*b* . . . in the cover 18 of the electromagnetic induction actuator 1.

The outer casing 4 comprises an upper case 40 and an under case 41. There are sound holes 41*a*, 41*b* . . . in the upper case 40. Inside the upper case 40 there is a stop rim 43 for the electromagnetic induction actuator 1 covered by the bushing 3. This stop rim 43 has a concavity 44 into which the projection 34 of the bushing 3 is fitted, and so it can take the form of equally spaced stops around the periphery of the bushing 3.

On the inside of the upper case 40 there is also a push rim 45 that pushes down the extension flange 32 of the bushing 3. This push rim 45 can be a circular rim that faces the extension flange 32 of the bushing 3. It is also possible to have, together with the stop rim 43 of the electromagnetic induction actuator 1, a stopper rim 46 that pushes against the end of the terminal block 10*d*. And on the under case 41 there is a receiver rim 47 that holds the circuit board 2 in place.

To mount the electromagnetic induction actuator 1 in the outer casing 4 using these parts, first electromagnetic induction actuator 1 is covered with the bushing 3, with the terminal block 10*d* projecting through the opening 33. Next the electromagnetic induction actuator 1, covered by the bushing 3, is placed in the space defined by the stopper rim 46 and the multiple stop rims 43 within the upper case 40.

Through this placement of the electromagnetic induction actuator 1, the projection 34 of the bushing 3 is fitted into the concavity 44 of the stop rim 43, and so it is possible to simply fix the electromagnetic induction actuator 1 inside the upper case 40. By fixing this electromagnetic induction actuator 1 in place, moreover, the extension flange 32 of the bushing 3, including the projecting band 37, is compressed by the circular push rim 45, and so it surrounds the sound holes 42*a*, 42*b* . . . in the central part of the upper case 40 and, as a seal that is in close contact with the push rim 45, prevents acoustical leakage within the upper case 40.

The upper case 40 with the electromagnetic induction actuator 1 assembled within it is then fitted and fixed to the under case 41 in which the circuit board 2 has been mounted. As this is done, the leaf springs 17*a* of the terminal fittings 17 are pressed against the conductive pattern 20 of the circuit board 2 and the extension flange 31 of the bushing 3, including the projecting band 36, is compressed by the surface of the circuit board 2.

Because of this pressure, the extension flange 31 of the bushing 3, including the projecting band 36, is compressed to a specified thickness, so that it becomes a pad that establishes a fixed spacing between the electromagnetic induction actuator 1 and the surface of the circuit board 2. At the same time, the leaf springs 17*a* of the metal terminal 17 are deformed by pressure and placed in close contact with the conduction pattern 20 of the circuit board 2, providing a sure electrical connection.

Furthermore, because the bushing 3 is an elastic material, the extension flanges 31, 32 prevent the vibration produced by the electromagnetic induction actuator 1 from being transferred to the circuit board 2 and the upper case 40. This prevents resonance and provides good acoustical characteristics, and it protects the internal structure from damage from impact. In particular, keeping the area of contact between the projecting band 36 of the bushing 3 and the surface of the circuit board 2 small allows close contact, and assures prevention of resonance.

The metal terminals 17 have leaf springs 17*a* of which the knuckles project downward at a slant from the housing 10, and the tips are bent in a V shape. Therefore, with the electromagnetic induction actuator 1 fixed in place by the stop rim 43, the contact points of the leaf springs are deformed into rounded claws, and provide a sure electrical connection without damaging the conductive pattern 20 of the circuit board 2.

Figure 13:
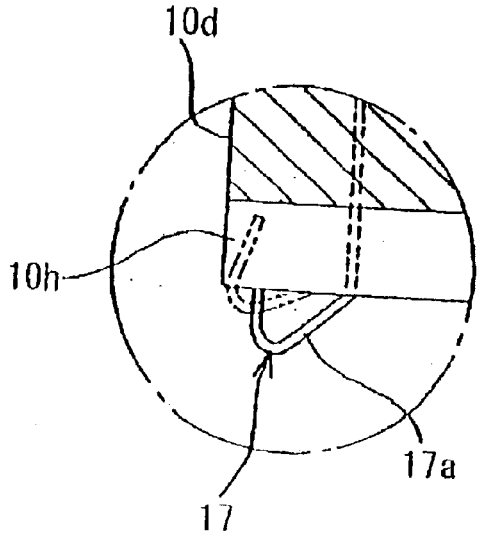
FIG. 13 is an explanatory drawing showing the elastic deformation of the leaf spring in the electromagnetic induction actuator in FIG. 1.
Figure 14:
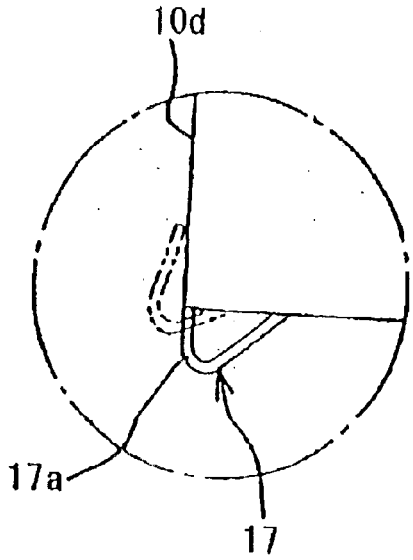
FIG. 14 is an explanatory drawing showing another example of the elastic deformation of the leaf spring in the electromagnetic induction actuator in FIG. 1.

The leaf springs 17*a* of the meal terminals 17 are deformed by bending them into a recess 10*h* that is cut into the terminal block 10*d*, as shown in FIG. 13. Or as shown in FIG. 14, it is possible to deform the leaf springs 17*a* with their tips retreating along the end face of the terminal block 10*d*.

Figure 15:
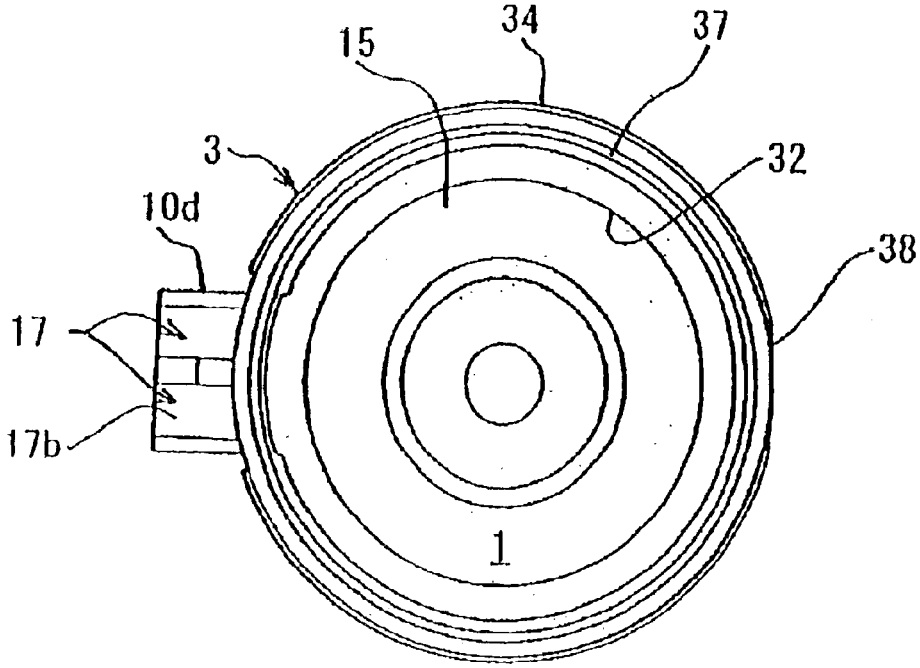
FIG. 15 is a plane view showing, from the diaphragm side, the electromagnetic induction actuator covered with a different bushing that suits the mounting structure of implementation mode 1 of this invention.
Figure 16:
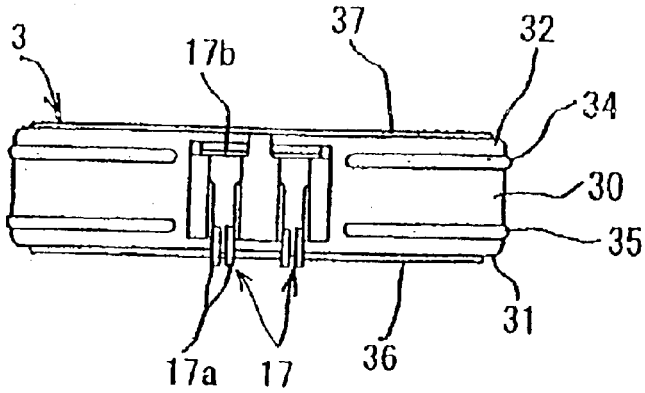
FIG. 16 is a front view of the electromagnetic induction actuator of FIG. 15.
Figure 17:
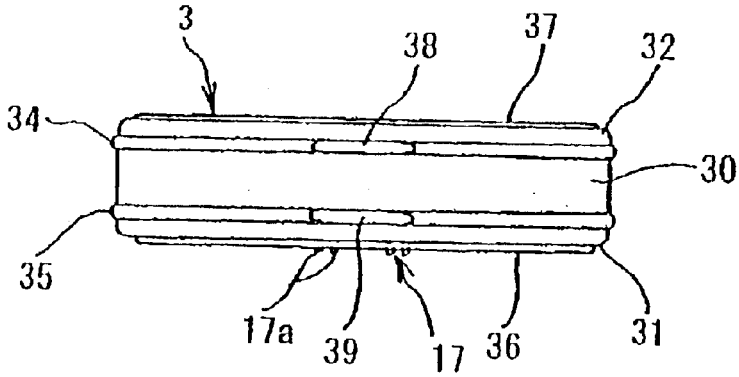
FIG. 17 is a back view of the electromagnetic induction actuator of FIG. 15.

In the mode of implementation described above, the side wall 30 of the bushing 3 has circular projections 34, 35 around the outer periphery. Instead, however, it is possible to cut out sections 38, 39 to the level of the side wall 30, as shown in FIGS. 15 through 17. By this means the overall width of the electromagnetic induction actuator, measured from the terminal block 10*d*, can be made narrower.

It is also possible to use, instead of the bushing 3 covering the housing 10, a number of projections 5 of elastic material that are fitted and fixed to the outside of the side wall 10*c* at fixed intervals around the circumference. The projections 5, as in the mode of implementation described above, fit into concavities 44 in the stop ridge 43 inside the upper housing 40 as shown in FIG. 19, by which means the electromagnetic induction actuator 1 can be firmly attached.

In the event that these projections 5 are used, the open side 10*b* of the housing 10 is covered with rubber, silicone or some other elastic material 6 that becomes a pad sandwiched between the circuit board 2 and the open side 10*b* of the housing 10. A rubber, silicone or other elastic material 7 that covers the other open side 10*a* of the housing 10 can be placed inside the upper case 40 to enclose the sound holes 42*a*, 42*b* . . .

Figure 18:
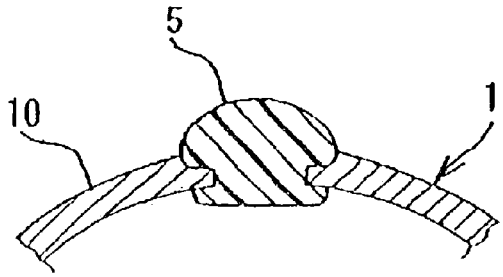
FIG. 18 is a cross-sectional detail of a different housing, with a projection, that suits the mounting structure of implementation mode 1 of this invention.
Figure 19:
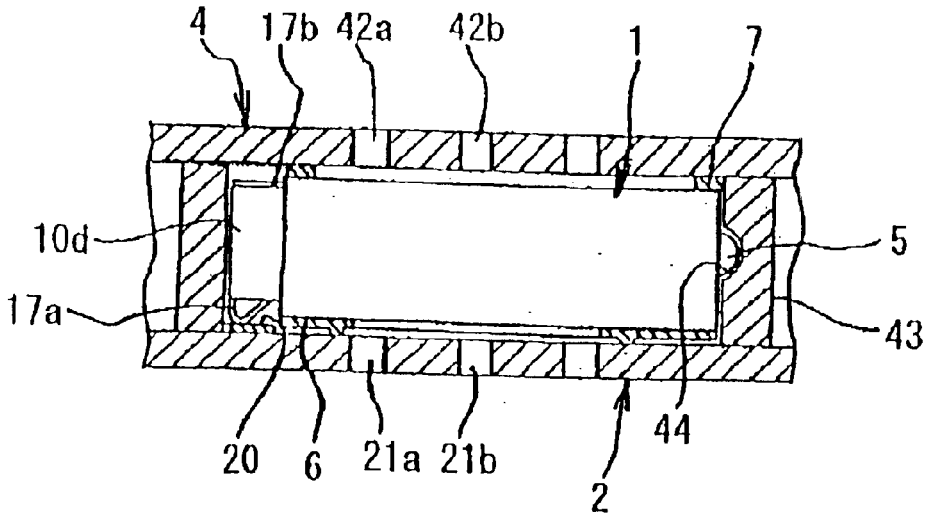
FIG. 19 is an explanatory drawing of the structure for mounting the electromagnetic induction actuator in an implementation other than implementation mode 1 of this invention.
Figure 20:
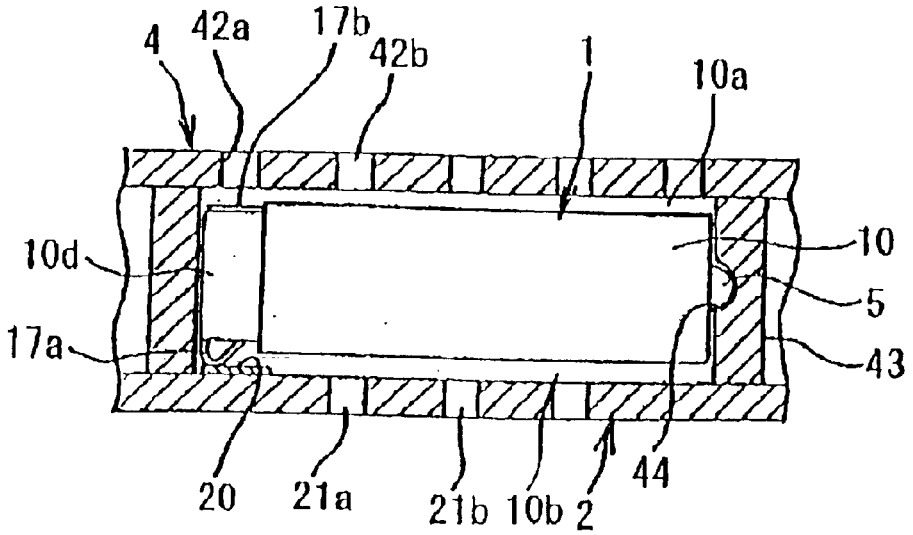
FIG. 20 is an explanatory drawing of the structure for mounting the electromagnetic induction actuator that applies to the modes of implementation in FIGS. 18 and 19.

Now in the mode of implementation shown in FIGS. 18 and 19, the housing 10 has about 3 projections 5 of elastic material fitted and fixed into the outer surface of the side wall 10*c* at fixed intervals. By fitting into concavities 44 in the stop rim 43, these projections 5 hold the electromagnetic induction actuator 1 in place and thereby prevent the resonance that would accompany vibration, and keep the electromagnetic induction actuator 1 from moving up and down.

Therefore, because the purpose is to make an electrical connection between the leaf spring 17*a* and the conductive pattern 20 of the circuit board 2, this is suitable as a structure for mounting the electromagnetic induction actuator 1 against the conduction pattern 20 of the circuit board 2, even without elastic material sandwiched between the circuit board 2 and the open sides 10*a* and 10*b* of the housing 10, or seal material inside the outer casing 4.

In the mode of implementation described above, the stop rim 43 for the electromagnetic induction actuator 1 has been explained as a raised feature inside the upper case 40. It is possible, however, for the stop rim 43 to be attached to the surface of the circuit board 2.

Implementation Mode 2

Implementation mode 2 is explained below with reference to FIGS. 21 through 35. For convenience in explaining, when specifying the orientation of the electromagnetic induction actuator the side facing the cover panel of the equipment will be taken as upward, and the side corresponding to the circuit board as downward.

Figure 21:
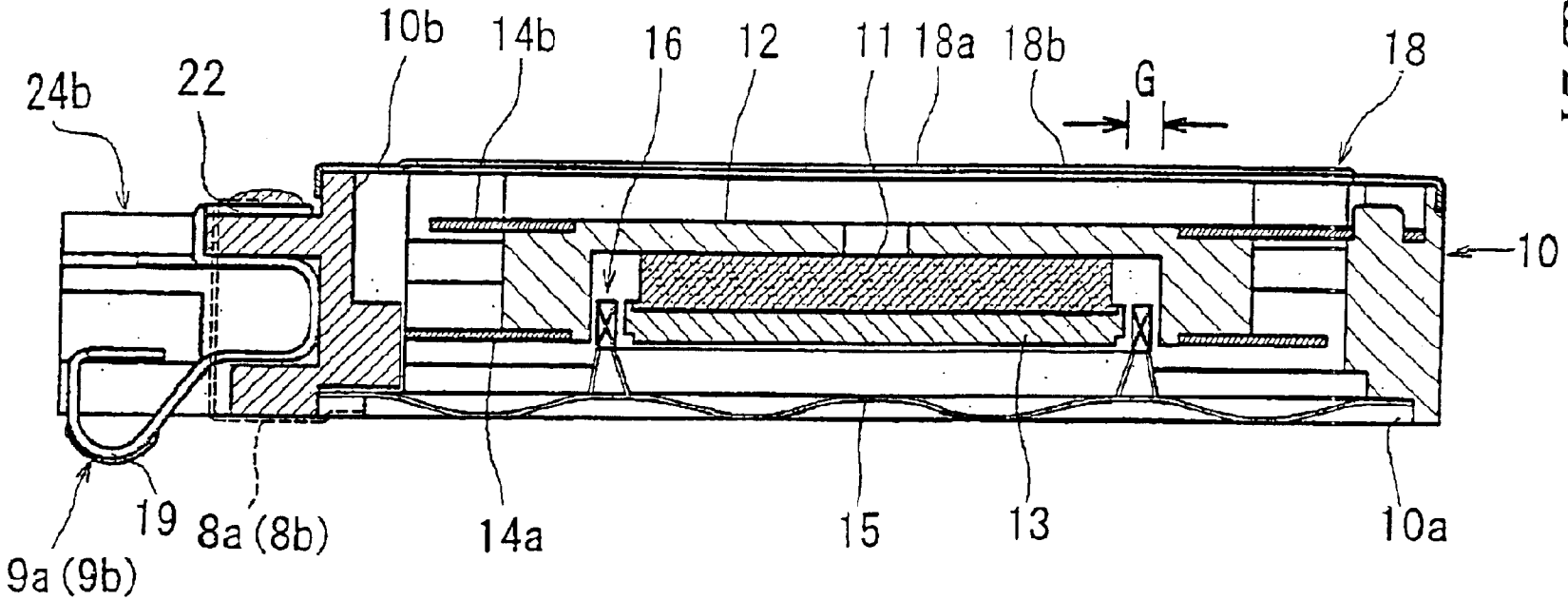
FIG. 21 is a cross section of the internal structure of the electromagnetic induction actuator of implementation mode 2 of this invention.

The basic mode of the electromagnetic induction actuator is enclosed in a cylindrical housing 10 as shown in FIG. 21, and has a pole piece 13 and magnet 11 together as one piece separated by a magnetic gap 13 that together with a dish-shaped yoke 12 that hold the magnet 11 and pole piece 13 together make up the magnetic circuit. The magnetic circuit is suspended by spring suspension 14*a*, 14*b* within the housing 10.

In addition, there is a voice coil 16 mounted on the inward surface side of a diaphragm 15; the voice coil 16 is inserted into the magnetic gap G between the pole piece 13 and the yoke 12. The diaphragm 15 is extended within the framework at the open side 10*a* of the housing 10, and the lead wires 8*a* (8*b*) of the voice coil 16 are electrically connected to the terminal fittings 9*a* (9*b*) on the terminal block 24*b* that projects out from the side wall of the housing 10. A cover 18 with plural sound holes 18*a*, 18*b* . . . covers the open side 10*b* of the housing 10.

The metal terminals 9*a* (9*b*) (hereafter, parts of the same terminal will be labelled with a same number) have contact points 19 that make electrical contact with the conduction pattern of the circuit board (not illustrated) and are on the side where the diaphragm 15 is mounted. The flat plates 22 to which the lead wires 8*a* of the voice coil 16 arc electrically connected are on the side where the cover 18 is mounted.

Figure 22:
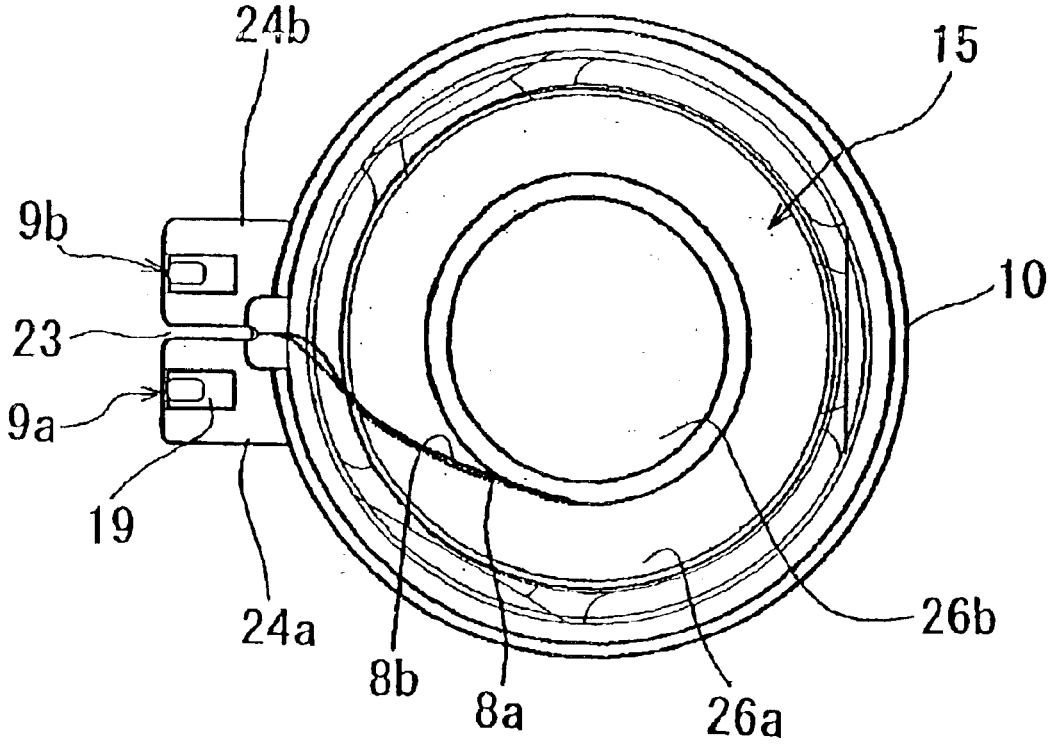
FIG. 22 is a bottom view of the electromagnetic induction actuator of FIG. 21.
Figure 23:
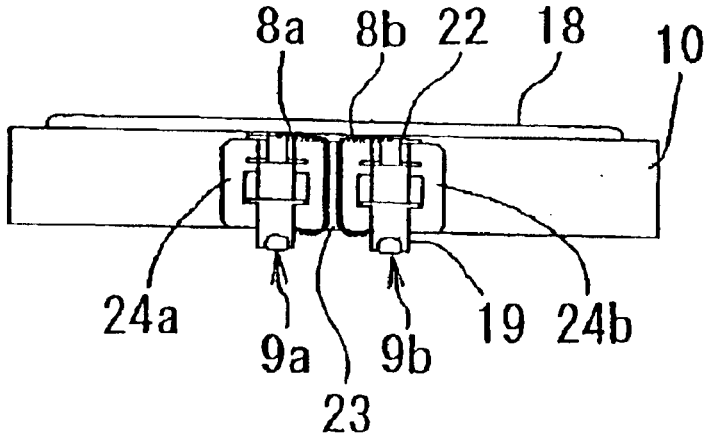
FIG. 23 is a side view of the electromagnetic induction actuator of FIG. 21.
Figure 24:
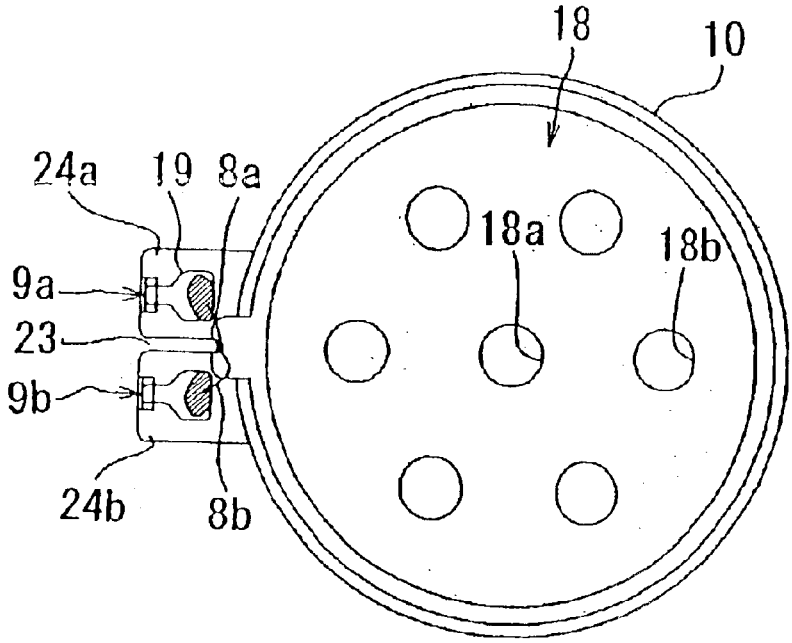
FIG. 24 is a plane view of the electromagnetic induction actuator of FIG. 21.

With these metal terminals 9*a*, 9*b*, there are voice coil (not illustrated) leads 8*a*, 8*b* that extend out of the housing 10 on the diaphragm 15 side, as shown in FIGS. 22 to 24, up to the side oppose the diaphragm 15, where the leads 8*a*, 8*b* of the voice coil 16 are separated and connected electrically to the flat plates 22 of positive and negative polarity of metal terminals 9*a*, 9*b* on the side where the cover 18 is attached.

Figure 25:
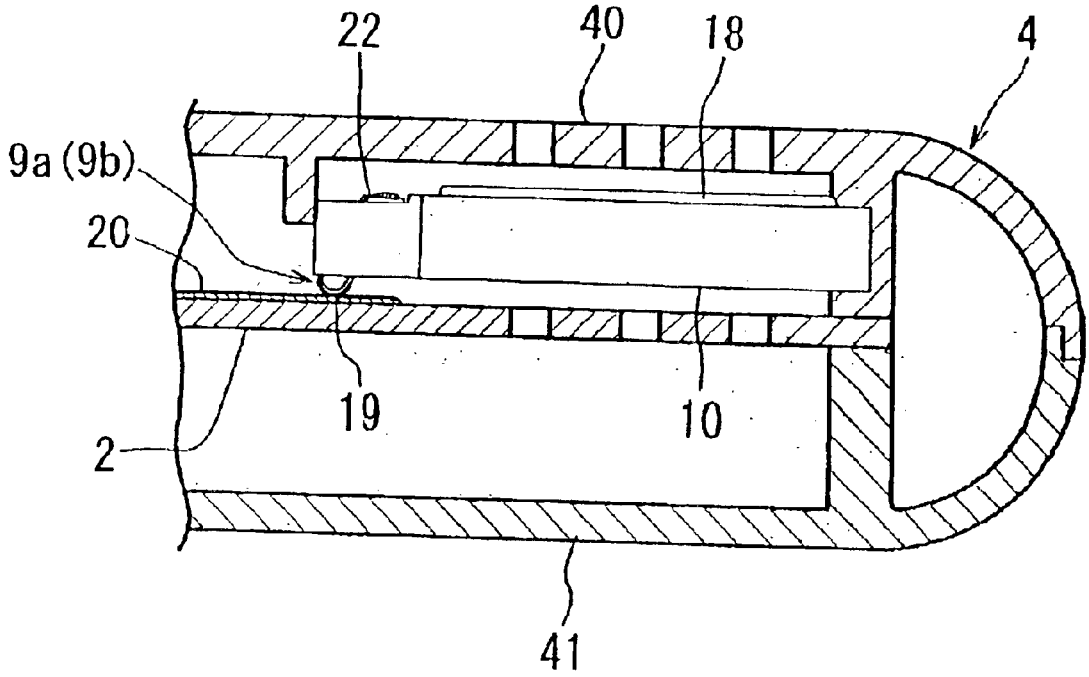
FIG. 25 is an explanatory drawing of the mounting structure within a portable telephone or other equipment, given as an example of mounting the electromagnetic induction actuator of FIG. 21.

The electromagnetic induction actuator constituted in this way, when mounted in a portable telephone or other equipment as shown in FIG. 25, has the side where the cover 18 is attached facing the upper case 40 of the outer casing 4 of the equipment, and the side where the diaphragm (not illustrated) is mounted facing the surface of the circuit board that is mounted between the upper case 40 and the under case 41, so that the electromagnetic induction actuator is mounted upside down within the outer casing 4.

This electromagnetic induction actuator is mounted with the side where the cover 18 is attached, which allows little flux leakage, faces the upper case 40 of the outer casing 4, and the side where the diaphragm 15 is mounted, where there is more flux leakage, facing the surface of the circuit board 2. Therefore, leakage of the alternating magnetic field to the outside through the upper case 40 of the outer casing 4 is suppressed, and any effect of the alternating magnetic field on magnetic memory cards is prevented.

At the same time, the lead wires 8*a* (8*b*) of the voice coil 16 are divided by polarity and soldered to the flat plates 22 of the metal terminals 9*a* (9*b*) on the side where the cover 18 is attached, which faces the upper case 40 of the outer casing 10. Thus the solder mounds on the metal terminals 9*a* (9*b*) do not interfere with the electrical circuit connection between the contact points 19 and the conductive pattern 20 of the circuit board 2.

Within this constitution, the terminal block 24*a*, 24*b* has at its center a slit 23, as shown in FIGS. 22 through 24, and is divided into halves 24*a* and 24*b* for the positive and negative polarities on the side wall of the housing 10. The voice coil leads 81, 8*b* are extended up through the slit 23 to the cover 18 attached to the terminal block 24*a*, 24*b*, and are divided by polarity and electrically connected to the flat plates 22 of the metal terminals 9*a*, 9*b*.

The layout structure of the lead wires is that the lead wires 8*a*, 8*b* of the voice coil 16 pass through the slit 23 and are laid out stably over a short distance, so that a sure electrical connection can be made to the flat plates of the metal terminals 9*a*, 9*b*.

Figure 26:
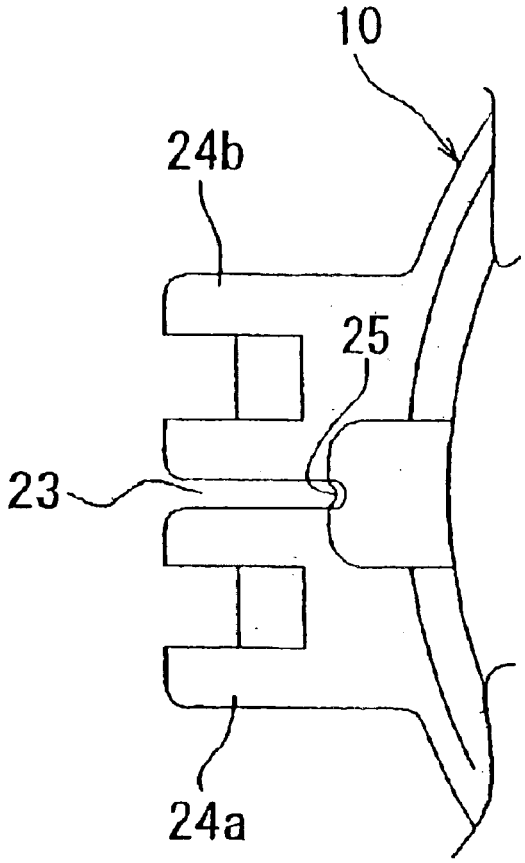
FIG. 26 is a bottom view of the terminal block in the housing of the electromagnetic induction actuator of FIG. 21.

On the side where the lead wires extend past the diaphragm 15, a rounded chamfer 25 can be made in the peripheral rim of the housing 10 to connect with the slit 23, as shown in FIG. 26. This chamfer 25 prevents damage to the insulation of the lead wires 8*a*, 8*b* that extend through the slit 23 to the side where the cover 18 is attached.

The diaphragm 15, as shown in FIG. 22, can be divided into an outer periphery 26*a* that is fixed to the housing 10, and a central portion 26*a* to which the voice coil is mounted, with the voice coil lead wires 8*a*, 8*b* drawn through the seam where the outer periphery 26*a* and the central portion 26*b* are joined into a single piece.

Because the lead wires are drawn in such a way that the voice coil lead wires 8*a*, 8*b* are laid outside the outer periphery 26*a*, the voice coil lead wires 8*a*, 8*b* do not contact the magnetic circuit within the housing 10 and breakage of the lead wires is prevented.

Figure 27:
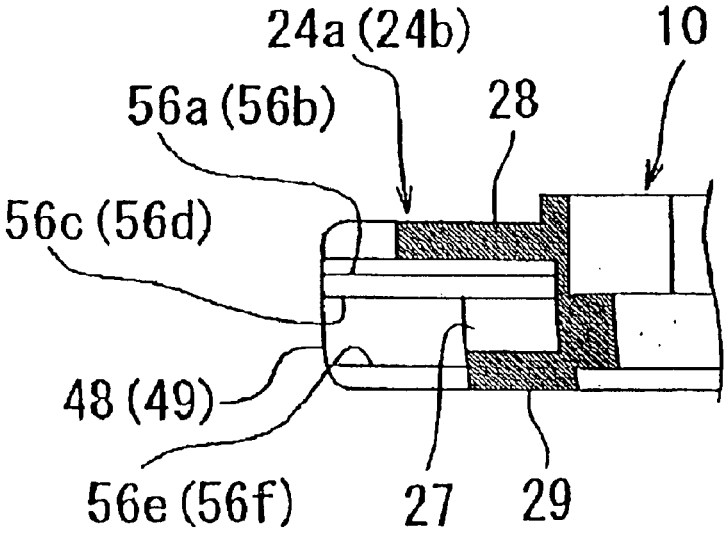
FIG. 27 is a cross section of the terminal block in the housing of the electromagnetic induction actuator of FIG. 21.
Figure 28:
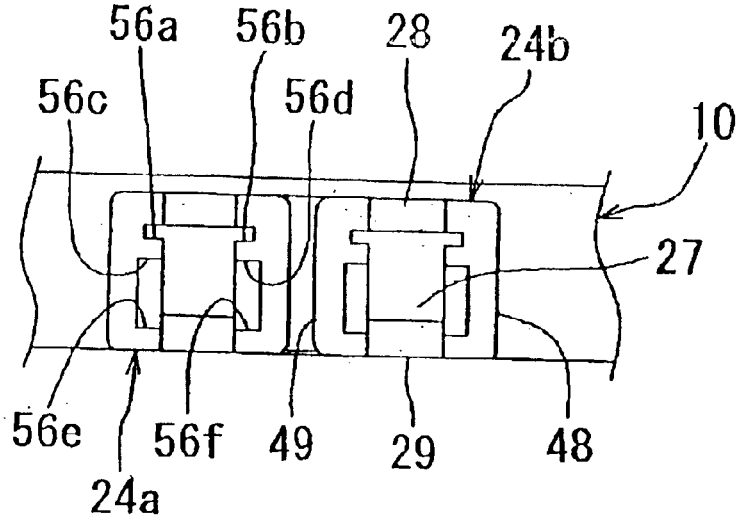
FIG. 28 is a front view of the terminal block in the housing of the electromagnetic induction actuator of FIG. 21.
Figure 29:
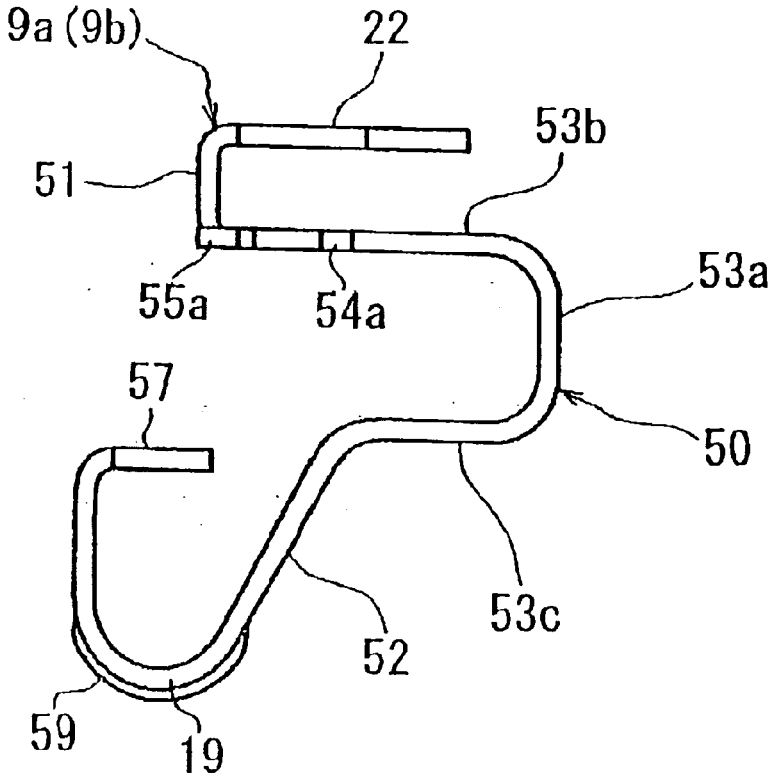
FIG. 29 is a side view of the metal terminal to be mounted in the terminal block in the housing of the electromagnetic induction actuator of FIG. 21.

The terminal block 24*a* (24*b*), as shown in FIGS. 27 and 28 (hereafter, parts of the same terminal block will be labelled with same number), has a sink 27 in the center, which is divided vertically into a top plate 28 and a bottom plate 29 side plate 48, 49 projecting further than the top plate 28 and the bottom plate 29, and the sink 27 is divided horizontally into the side plate 48, 49.

The metal terminals 9*a* (9*b*) are formed by bending a thin metal sheet of good electrical conductivity, such as phosphor bronze or titanium bronze. These meal terminals 9*a* (9*b*) are shaped, as shown in FIGS. 29 through 32, with a left-opening box-shaped fitted bend 50 in the center; upward from the fitted bend 50 by a given interval is the parallel flat plat 22 to which the lead wire is soldered, and downward from the fitted bend 50 the leaf spring 52 extends at a slant and is then rounded upward with a contact point 19 that contacts the conductive pattern of the circuit board.

Figure 33:
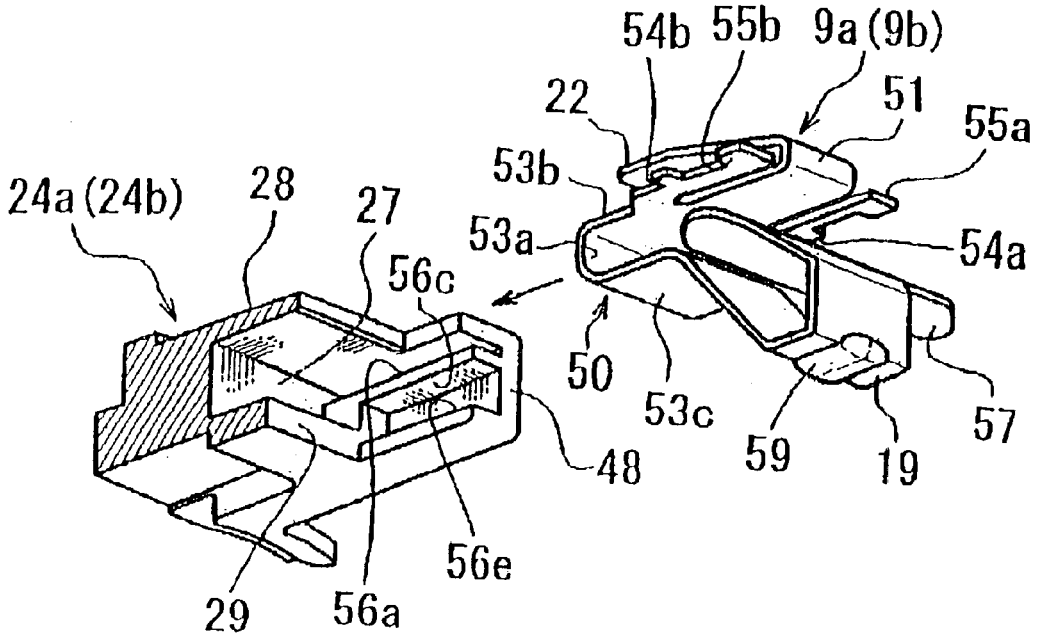
FIG. 33 is an explanatory drawing of the relative positions of the terminal block and the metal terminal in the housing of the electromagnetic induction actuator of FIG. 21.

These metal terminals 9*a* (9*b*) are assembled as shown in FIG. 33: leading with the bridge 53*a*, the fitted bend 50 is pressed into the sink 27 of the terminal block 24*a* (24*b*), the top plate 28 is clamped between the flat plate 22 to which a lead wire is connected and the top 53*b* of the fitted bend 50 and the fitted bend 50 is fitted into the sink 27, and the contact point 19 that connects to the conduction pattern of the circuit board projects from the bottom plate 29 of the terminal block 24*a* (24*b*), thus these metal terminals 9*a* (9*b*) are supported by side plates 48, 49 and are assembled.

Figure 34:
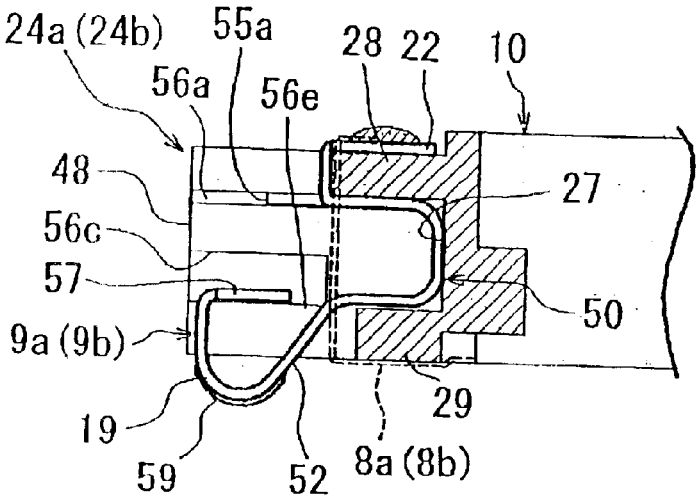
FIG. 34 is an explanatory drawing showing the mounting structure of the metal terminal in the terminal block of the electromagnetic induction actuator of FIG. 21.

By means of the structure for fitting this metal terminals 9*a* (9*b*), as shown in FIG. 34, the top 53*b* and bottom 53*c* of the fitted bend 50 are pressed between the top plate 28 and bottom plate 29 of the sink 27, and the top plate 28 is clamped between the flat plate 22 to which a lead wire is connected and the top 53*b* of the fitted bend 50 so that by pressing the fitted bend 50 into the sink 27, the metal terminals 9*a* (9*b*) is fixed firmly into the terminal block 24*a* (24*b*).

Together with that, the contact point 19 projects down from the bottom plate 29 of the terminal block 24*a* (24*b*), by means of which the metal terminal 9*a* (9*b*) is attached within the terminal block 24*a* (24*b*) by side plates 48, 49 without extending beyond it, so that the device as a whole can be assembled more compactly.

Figure 30:
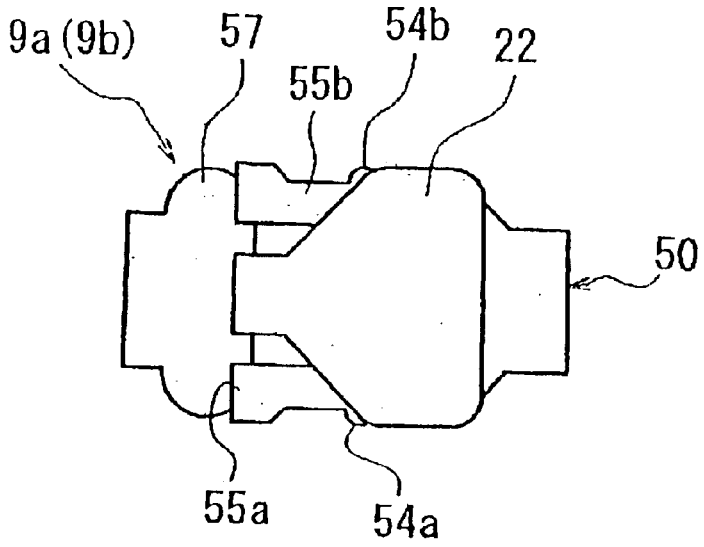
FIG. 30 is a plane view of the metal terminal in FIG. 29.
Figure 31:
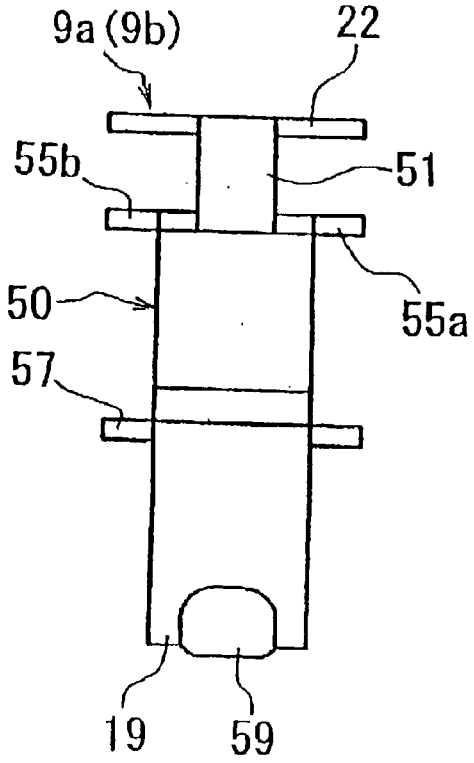
FIG. 31 is a right side view of the metal terminal in FIG. 29.
Figure 32:
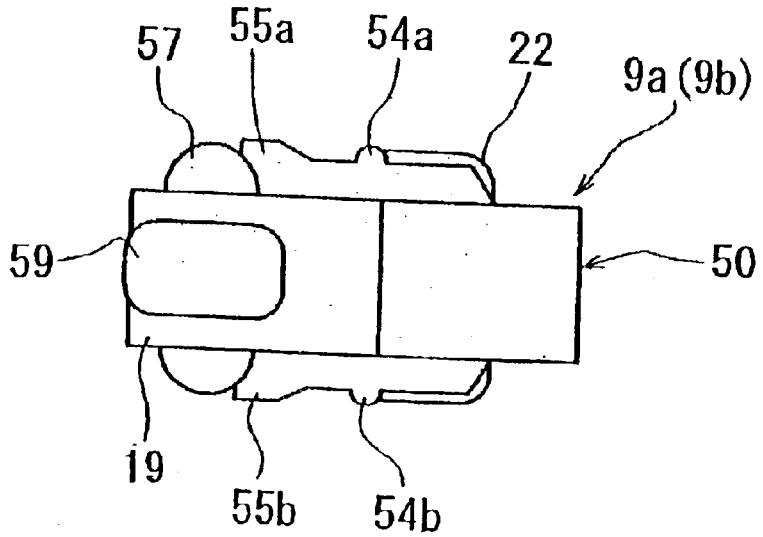
FIG. 32 is a bottom view of the metal terminal in FIG. 29.

In addition to this constitution of the metal terminal and terminal block, the metal terminals 9*a*, 9*b* can have a number of teeth 54, 55, as shown in FIGS. 30 and 33, projecting outward from both sides of the top 53*b* of the fitted bend 50, as do side-cut spring arms 55*a*, 55*b*. On the other hand, the terminal block 24*a* (24*b*) has spaces that correspond to the thickness of the spring arms 55*a*, 55*b*, and receiving plates 56*a*, 56*b* that face the top plate 28 on the inner face of side plates 48, 49.

In this constitution, the spring arms 55*a*, 55*b* of the metal terminal 9*a* (9*b*) fits between the top plate 28 and the receiving plates 56*a*, 56*b* of the side plates 48, 49 of the terminal block 24*a* (24*b*), and the teeth 54*a*, 54*b* are compressed by the inward faces of the side plates 48, 49, so that the metal terminals 9*a* (9*b*) can be fixed even more firmly into the terminal block 24*a* (24*b*).

There are on the metal terminal 9*a* (9*b*) wing-shaped leaf springs 57 that curve outward at the tip of the leaf spring 52 where it is bent back from the contact point 19 and that extend toward the sides of the terminal block 24*a* (24*b*). The terminal block 24*a* (24*b*) has receiving piers 56*c*, 56*d* on the inner walls of its side plates that stop and support the wing-shaped leaf springs 57 when the leaf spring 52 is compressed.

Figure 35:
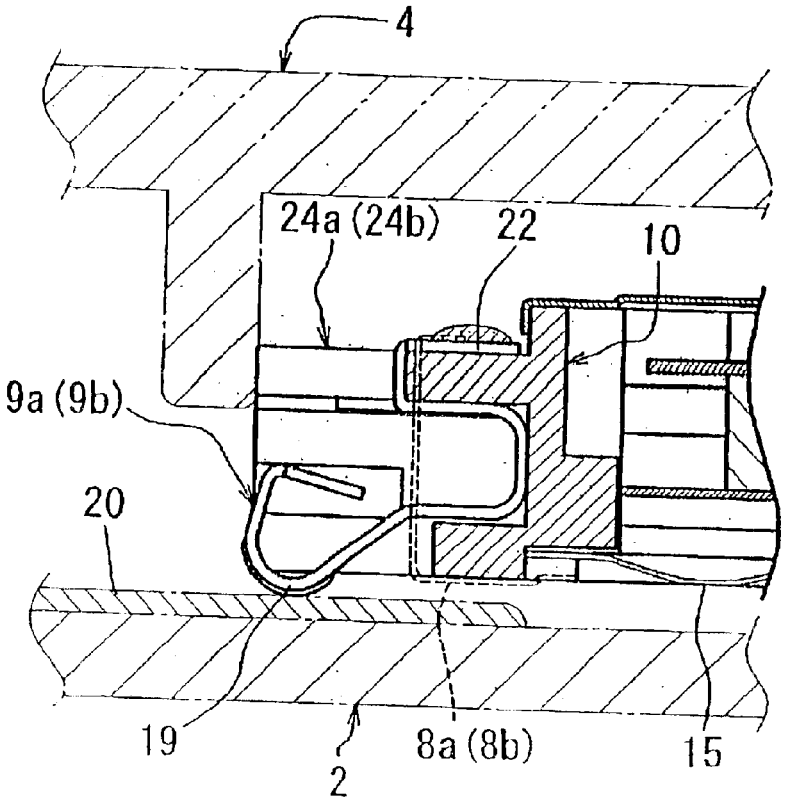
FIG. 35 is an explanatory drawing showing the structure of the point of contact of the metal terminal in the terminal block of the electromagnetic induction actuator of FIG. 21.
Figure 36:
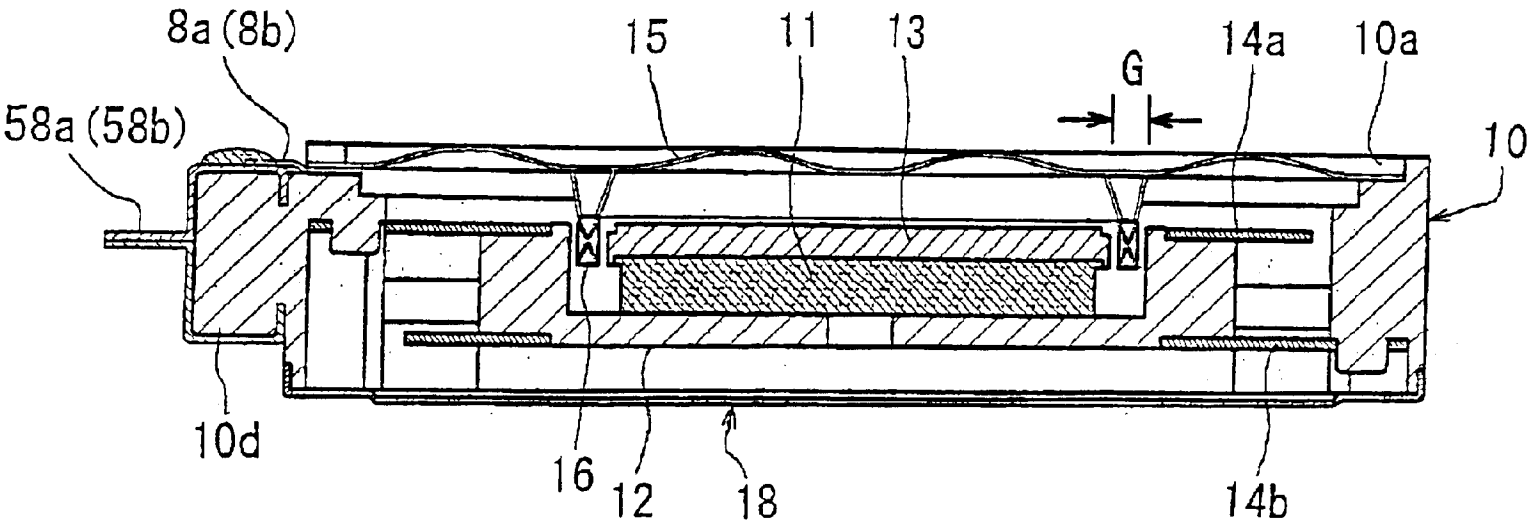
FIG. 36 is a cross section showing the internal structure of the electromagnetic induction actuator of an example of the prior art.

With these constituent parts, when the contact point 19 is pressed against the conduction pattern 20 of the circuit board 2 as shown in FIG. 35, as the metal terminal 9*a* (9*b*) is compressed, the wing-shaped leaf springs 57 arc pressed against the receiving plates 56*c*, 56*d* which stop them so that the metal terminal 9*a* (9*b*) is held in firm contact with the conductive pattern 20 and a sure electrical connection is obtained.

Now, the receiving piers 56*c*, 56*d* for the wing-shaped leaf springs 57 are the other sides of the receiving plates 56*a*, 56*b* for the spring arms 55*a*, 55*b*. There arc, on the inner surface and lower edge of the side plates 48, 49, receiving plates 56*e*, 56*f* that determine the extent of projection of the contact point 19 when the metal terminal 9*a* (9*b*) is fitted into place (see FIGS. 28 and 33).

Aside from what has been described above, there can be a projecting band 59 that runs along the center of the curve of the contact point 19 in order to make contact with the conductive pattern 20 of the circuit board 2. This projecting band 59 is a lip that reinforces the contact point 19; it prevents distortion of the shape of the contact point 19 even under strong pressure against the conduction pattern 20 of the circuit board 2, and thus provides an even surer electrical contact between the terminal fitting and the conduction pattern 20.

The electromagnetic induction actuator having metal terminals of this sort is assembled into the equipment with the side on which the diaphragm 15 is mounted facing the circuit board 2 and the other side facing the panel of the outer casing 4, and so leak of the alternating magnetic field leaving from leaving the outer can be suppressed, thus preventing any effect on magnetic storage cards.

Along with that, an electrical circuit connecting the metal terminal 9*a* (9*b*) to the conduction pattern 20 of the circuit board 2 is easily assembled within the equipment, and because the metal terminal 9*a* (9*b*) is firmly in place within the terminal block 24*a* (24*b*) of the housing 10, the circuit connection to the conductive pattern 20 of the circuit board 2 is electrically sure, and the equipment as a whole can be assembled compactly.

Now, the terms and expressions in the specification of this invention are used to give an easily understood explanation of this invention; the terms and expressions used in no way limit the technical concepts of the explanation. There has been no intention of excluding anything equivalent to the mode of the invention described above, or to any part thereof, by the use of limiting terms or expressions.

In particular, explanation was made in terms of the electromagnetic induction actuator having the side facing the cover panel of the equipment proper upward, and the side facing the circuit board downward, but that is strictly for the convenience of explanation; the same is true of the top plate and bottom plate of the terminal block. It is possible, therefore, to change the various expressions within the scope of the invention for which rights are claimed.

Potential for Industrial Use

As stated above, the electromagnetic induction actuator of this invention, the mounting structure for an electromagnetic induction actuator and portable information equipment including portable telephones are constituted with leaf spring metal terminal. The metal terminal is deformed by compression and put into close contact with the conduction pattern of the circuit board when the electromagnetic induction actuator is assembled into the portable information equipment, providing a sure electrical connection. Moreover, the electromagnetic induction actuator can be assembled into the equipment easily, and so it is well suited to use in portable telephones and other portable information equipment.

What is claimed is:

1. A structure within a cylindrical housing for mounting an electromagnetic induction actuator comprising, a magnetic circuit comprising a pole piece and a magnet connected as one piece, and a yoke that holds the pole piece and magnet together with a magnetic gap formed between the yoke and the pole piece, the magnetic circuit supported within the housing by leaf springs;

a diaphragm, to the inward side of which is attached a voice coil, the voice coil projecting into the magnetic gap between the pole piece and the yoke, and the diaphragm extending inside the housing through a first open side;

a terminal fitting that is attached to a terminal block that projects outward from the side wall of the housing and lead wires that electrically connect the voice coil and the terminal fitting;

wherein the terminal block is facing a second open side of the housing in which the diaphragm is fitted and fixed, and a pad of elastic material is sandwiched between the second open side of the housing and the surface of a circuit board on the side of the housing where a leaf spring projects, so that pressing the terminal fitting against a conductive pattern of the circuit board forms an electrical connection to the circuit board; and a bushing of elastic material with circular extension flanges that covers the outside of the side wall of the housing, except for the terminal fittings on the terminal block, and that covers the first open side of the housing, such that the extension flange that covers the first open side of the housing becomes a pad that is sandwiched between the housing and the surface of the circuit board, and the extension flange that covers the second open side of the housing is positioned inside the outer casing as a seal that surrounds sound holes.

2. A structure within a cylindrical housing for mounting an electromagnetic induction actuator comprising, a magnetic circuit comprising a pole piece and a magnet connected as one piece, and a yoke that holds the pole piece and magnet together with a magnetic gap formed between the yoke and the pole piece, the magnetic circuit supported within the housing by leaf springs;

a diaphragm, to the inward side of which is attached a voice coil, the voice coil projecting into the magnetic gap between the pole piece and the yoke and the diaphragm extending inside the housing through a first open side;

a terminal fitting that is attached to a terminal block that projects outward from the side wall of the housing and lead wires that electrically connect the voice coil and the terminal fitting;

wherein the terminal block is facing a second open side of the housing in which the diaphragm is fitted and fixed, and a pad of elastic material is sandwiched between the second open side of the housing and the surface of a circuit board on the side of the housing where a leaf spring projects, so that pressing the terminal fitting against a conductive pattern of the circuit board forms an electrical connection to the circuit board; and wherein the housing has multiple projections of elastic material at intervals along the outer periphery of the side wall and the circuit board or an outer casing has a stop rim having concavities into which the projections of the housing fit, such that fitting the projections of the housing into the concavities attaches the electromagnetic induction actuator to the stop rim of the outer casing or the circuit board.

3. An electromagnetic induction actuator that has, within a cylindrical housing, a magnetic circuit comprising a pole piece and a magnet connected as one piece, and a yoke that holds the pole piece together with a magnetic gap formed between the yoke and the pole piece, the magnetic circuit being supported within the housing by leaf springs;

a diaphragm, to the inward side of which is attached a voice coil, the voice coil projecting into the magnetic gap between the pole piece and the yoke, and the diaphragm extending inside the housing through an open side;

a terminal fitting that is attached to a terminal block that projects outward from the side wall of the housing; and lead wires that electrically connect the voice coil and the terminal fitting;

in which contact points that connect electrically to a conductive pattern of a circuit board are on the side where the diaphragm is mounted, and flat plates that are electrically connected to the voice coil lead wires are attached to leaf spring terminal fittings on the side opposite the side where the diaphragm is mounted, the voice coil lead wires being divided by positive and negative polarity and electrically connecting the side where the diaphragm is mounted to the flat plates of the terminal fittings on the opposite side, with the side where the diaphragm is mounted facing the surface of the circuit board, or mounted upside-down in an equipment case;

wherein the terminal block comprises a sink in the center of both a positive half and a negative half of the terminal block, the sink having a top plate and a bottom plate, of which the top plate extends further out than the bottom plate, and wherein the sink further comprises two side plates;

and in which there are the terminal fittings of the leaf spring material, each terminal fitting having a fitted bend in the center and a bend at the top section that is parallel to the fitted bend that forms a flat plate for attachment of the lead wire, and at the bottom the leaf spring that slants down and curves around to form the contact point for connection with the conductive pattern of the circuit board;

such that when the fitted bend is inserted into the sink and the top plate of the terminal block is clamped between the top of the fitted bend and the flat plate for attachment of the lead wire, the contact point for connection to the conductive pattern of the circuit board projects downward and is supported by the two side plates, with the terminal fitting firmly attached to the terminal block; and wherein the terminal fittings comprise projecting teeth that project from an outer rim and spring arms that extend from a clamping spring portion, as well as receiving piers on the inner surfaces of the side plates of the terminal block at a distance from the top plate that corresponds, to the thickness of the spring arms; such that by fitting the spring arms between the top plate and the receiving piers on each side plate and compressing the projecting teeth against the inner surfaces of the two side plates, the terminal fitting is mounted in the terminal block.

4. An electromagnetic induction actuator that has, within a cylindrical housing, a magnetic circuit comprising a pole piece and a magnet connected as one piece, and a yoke that holds the pole piece together with a magnetic gap formed between the yoke and the pole piece, the magnetic circuit being supported within the housing by leaf springs;

a diaphragm, to the inward side of which is attached a voice coil, the voice coil projecting into the magnetic gap between the pole piece and the yoke, and the diaphragm extending inside the housing through an open side;

a terminal fitting that is attached to a terminal block that projects outward from the side wall of the housing; and lead wires that electrically connect the voice coil and the terminal fitting;

in which contact points that connect electrically to a conductive pattern of a circuit board are on the side where the diaphragm is mounted, and flat plates that are electrically connected to the voice coil lead wires are attached to leaf spring terminal fittings on the side opposite the side where the diaphragm is mounted, the voice coil lead wires being divided by positive and negative polarity and electrically connecting the side where the diaphragm is mounted to the flat plates of the terminal fittings on the opposite side, with the side where the diaphragm is mounted facing the surface of the circuit board, or mounted upside-down in an equipment case;

wherein the terminal block comprises a sink in the center of both a positive half and a negative half of the terminal block, the sink having a top plate and a bottom plate, of which the top plate extends further out than the bottom plate, and wherein the sink further comprises two side plates;

and in which there are the terminal fittings of the leaf spring material, each terminal fitting having a fitted bend in the center and a bend at the top section that is parallel to the fitted bend that forms a flat plate for attachment of the lead wire, and at the bottom the leaf spring that slants down and curves around to form the contact point for connection with the conductive pattern of the circuit board;

such that when the fitted bend is inserted into the sink and the top plate of the terminal block is clamped between the ton of the fitted bend and the flat plate for attachment of the lead wire, the contact point for connection to the conductive pattern of the circuit board projects downward and is supported by the two side plates, with the terminal fitting firmly attached to the terminal block; and wherein the terminal fittings comprise protecting teeth that project from an outer rim and spring arms that extend from a clamping spring portion, as well as receiving piers on the inner surfaces of the side plates of the terminal block at a distance from the top plate that corresponds to the thickness of the spring arm; such that by fitting the spring arms between the top plate and the receiving piers on each side plate and compressing the projecting teeth against the inner surfaces of the two side plates, the terminal fitting is mounted in the terminal block;

wherein the terminal fitting further comprises the tip of the leaf spring that curves upward beyond the contact point and folds back inward and has the leaf springs that extend toward the two sides of the terminal block, and in which there are receiving piers on the inner surfaces of the two side plates that stop and support the leaf springs extending from the tip when the terminal fitting is deformed under pressure, such that the terminal fitting is mounted in the terminal block by a fitted structure that allows spring movement of the contact point.

5. A structure for mounting an electromagnetic induction actuator as described in claim 1 above, in which there is a circular projecting band of elastic material that faces the surface of the circuit board, the circular band being sandwiched between one open side of the housing and the surface of the circuit board as a pad that is deformed by compression.

6. A structure for mounting an electromagnetic induction actuator as described in claim 2 above, in which there is a circular projecting band of elastic material that faces the surface of the circuit board, the circular band being sandwiched between one open side of the housing and the surface of the circuit board as a pad that is deformed by compression.

7. A structure for mounting an electromagnetic induction actuator as described in claim 1 above, in which the electromagnetic induction actuator is suited to mounting within a portable telephone.

8. A structure for mounting an electromagnetic induction actuator as described in claim 2 above, in which the electromagnetic induction actuator is suited to mounting within a portable telephone.

* * * * *